US005660596A

United States Patent [19]

Rochefort

[11] Patent Number: 5,660,596

[45] Date of Patent: Aug. 26, 1997

[54] MAGNETICALLY RESPONSIVE BOWLING PINS

[75] Inventor: Lucien Rochefort, Beauport, Canada

[73] Assignee: Mendes Inc., Ste-Foy, Canada

[21] Appl. No.: 493,327

[22] Filed: Jun. 21, 1995

Related U.S. Application Data

[60] Continuation-in-part of Ser. No. 175,309, Dec. 29, 1993, abandoned, which is a division of Ser. No. 79,164, Jun. 18, 1993, abandoned.

[51] Int. Cl.[6] ..... A63D 9/00

[52] U.S. Cl. ..... 473/118; 473/85

[58] Field of Search ..... 473/73, 64, 85, 473/118

[56] References Cited

U.S. PATENT DOCUMENTS

| | | | |
|---|---|---|---|
| 596,543 | 1/1898 | Randall | 473/118 |
| 1,190,649 | 7/1916 | Hedenskoog | 473/85 |
| 2,346,428 | 4/1944 | Hanley | 473/118 |

*Primary Examiner*—William M. Pierce
*Attorney, Agent, or Firm*—McCormick, Paulding & Huber

[57] ABSTRACT

A magnetically responsive bowling pin having a first upwardly open cavity in its head portion and a second elongated cavity smaller and cross-section and extending downwardly in the head portion of a bowling pin. The first cavity receives a plastic cap having a top portion and a skirt with a permanent magnet and a plastic plug disposed in press fit engagement within the skirt. The skirt in turn is in press fit engagement with the wall of the first cavity to retain the assembled magnet and plastic parts in the desired position in the cavity. The second elongated cavity serves to remove material from the body of the bowling pin and thus compensates for the added weight of the permanent magnet and the slight additional weight of the plastic cap and plastic plug. As a result, the desired weight, weight distribution and balance of the bowling pin is not disturbed. In a second embodiment, the plastic cap has a through opening accessible upwardly and a small steel cap is mounted within the plastic cap and is exposed upwardly through the opening. The cap is also in engagement with the permanent magnet and results in enhancement of the magnetic forces.

25 Claims, 17 Drawing Sheets

MAGNETICALLY RESPONSIVE BOWLING PINS

RELATED APPLICATIONS

This is a continuation-in-part application of Ser. No. 08/175,309, entitled AUTOMATIC PINSETTER, filed Dec. 29, 1993, now abandoned, which is in turn a divisional application of Ser. No. 08/079,164, entitled AUTOMATIC PINSETTER, filed Jun. 18, 1993, now abandoned.

BACKGROUND OF THE INVENTION

A new generation of automatic pinsetters is expected to employ magnetic force in the handling and manipulation of bowling pins. Accordingly, there is a need for bowling pins which are magnetically responsive and which yet meet all other requirements such as gross weight, weight distribution, balance, plastic encapsulation, etc.

It is the general object of the present invention to provide a magnetically responsive bowling pin which is of relatively simple design and construction and which yet exhibits the foregoing characteristics and is durable in use over a long service life.

SUMMARY OF THE PRESENT INVENTION

In fulfillment of the foregoing object, a magnetically responsive bowling pin is provided with an upwardly open cavity in its head portion. A small permanent magnet is disposed in the cavity and is oriented to provide a magnetic field which extends upwardly therefrom. In preferred form, a plastic cap secured in and closing the cavity at least partially covers the magnet and secures the latter in position in the cavity. In a first embodiment, the cap completely covers the magnet and in a second embodiment an upwardly accessible opening is provided in the cap. A ferromagnetic element captured between the magnet and the cap top portion is exposed upwardly through the cap opening for enhanced efficiency of operation. Still further, a plastic plug is preferably disposed in the cavity beneath the permanent magnet and prevents the magnet from moving within a skirt portion of the plastic cap. External ribs with sharp edges are preferably provided on the skirt portion of the cap and are angularly inclined upwardly to resist withdrawal of the cap from the cavity. Similarly, internal ribs with sharp edges are preferably provided in the skirt for secure retention of the magnet and plug therewithin.

The bowling pin is preferably of plastic encapsulated wood construction with the cap being of a plastic construction identical or at least closely similar to the encapsulating plastic of the bowling pin.

In order to retain all elements positively in assembled relationship, the magnet is preferably in press fit engagement within the skirt of the cap with the skirt being in press fit engagement with the walls of the cavity in the head of the bowling pin. Similarly, the plastic plug beneath the magnet is in press fit engagement within the skirt of the cap.

Finally, in an order to preserve the desired gross weight, weight distribution and balance of the bowling pin, a second elongated cavity is provided in the bowling pin in communication with and somewhat smaller in cross-section then the first cavity which opens through the head of the bowling pin. The length of the second elongated cavity is such as to remove sufficient material to compensate for the added weight of the magnet and to preserve the desired weight, weight distribution and balance of the bowling pin.

DESCRIPTION OF THE PREFERRED EMBODIMENTS

Figure 1:
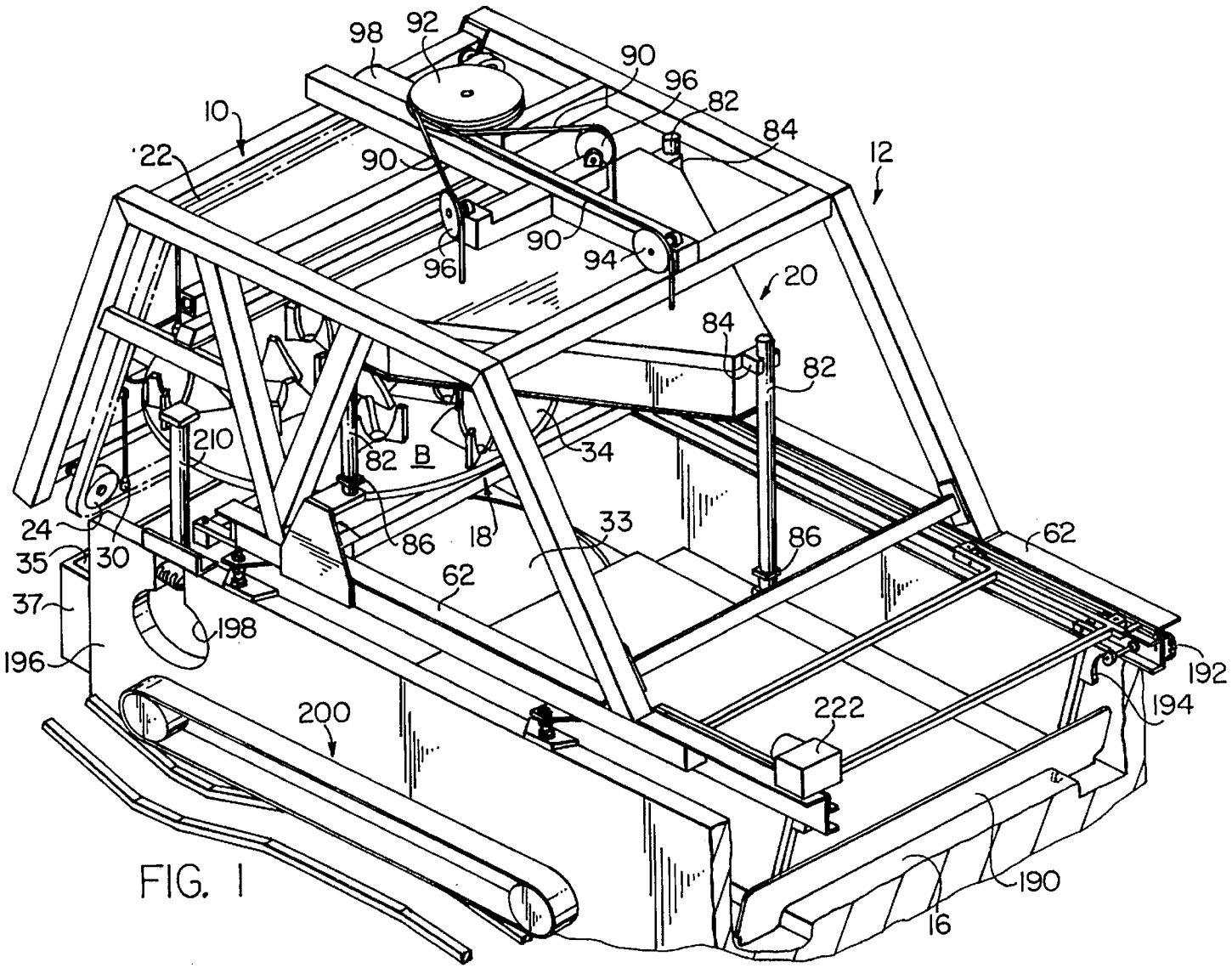
FIG. 1 of the drawings is a perspective view showing an automatic pinsetter.

The magnetically responsive bowling pins of the present invention may be used with a wide variety of automatic pinsetters which employ magne the handling of bowling pins. Accordingly, the bowling pins of the present invention are disclosed herein for use with the automatic pinsetter of FIG. 1 et sequa only as a matter of convenience in illustration and description. The brief description of the FIG. 1 pinsetter hereinbelow may be supplemented by reference to the aforementioned parent applications, hereby incorporated by reference in the present application.

Referring initially to FIGS. 1 through 4, it will be observed that an elevator mechanism indicated generally by the reference numeral 10 forms a part of an automatic pinsetter indicated generally by the reference numeral 12. The elevator mechanism operates to retrieve bowling pins seriatim from a pit area 14 adjacent a rear end of a bowling alley 16 and transports the same upwardly for delivery to a pin discharge station A. A transfer mechanism indicated generally at 18 is moveable between a loading station B adjacent and beneath the pin discharge station A to a pin delivery station C spaced horizontally forwardly from the loading station B and above the bowling alley 16. The transfer mechanism receives the bowling pins seriatim from the elevator mechanism at its locating station B and transfers the pins in bowling array to the pin delivery station C. At the pin delivery station C a vertically moveable pinsetting mechanism indicated generally at 20 is adapted to accept the bowling pins in bowling array and thereafter to deposit the same in bowling array on the bowling alley therebeneath. When the automatic pinsetter is provided with a plurality of magnetically responsive bowling pins as aforesaid, the pinsetting mechanism is provided with magnetic means for selectively magnetically holding and releasing the magnetically responsive pins whereby to remove the same from the transfer mechanism 18 and to deposit the same on the bowling alley 16. The pinsetting mechanism is moveable downwardly from its elevated position shown to an intermediate position above the transfer mechanism 18 shown in FIG. 2 at the delivery station C. At its intermediate position the pinsetting mechanism magnetically engages the bowling pins in bowling array and lifts the same to allow the transfer mechanism 18 to be withdrawn rearwardly to its loading station B. The pinsetting mechanism thereupon moves vertically downwardly to deposit the bowling pins on the bowling alley 16.

Figure 3:
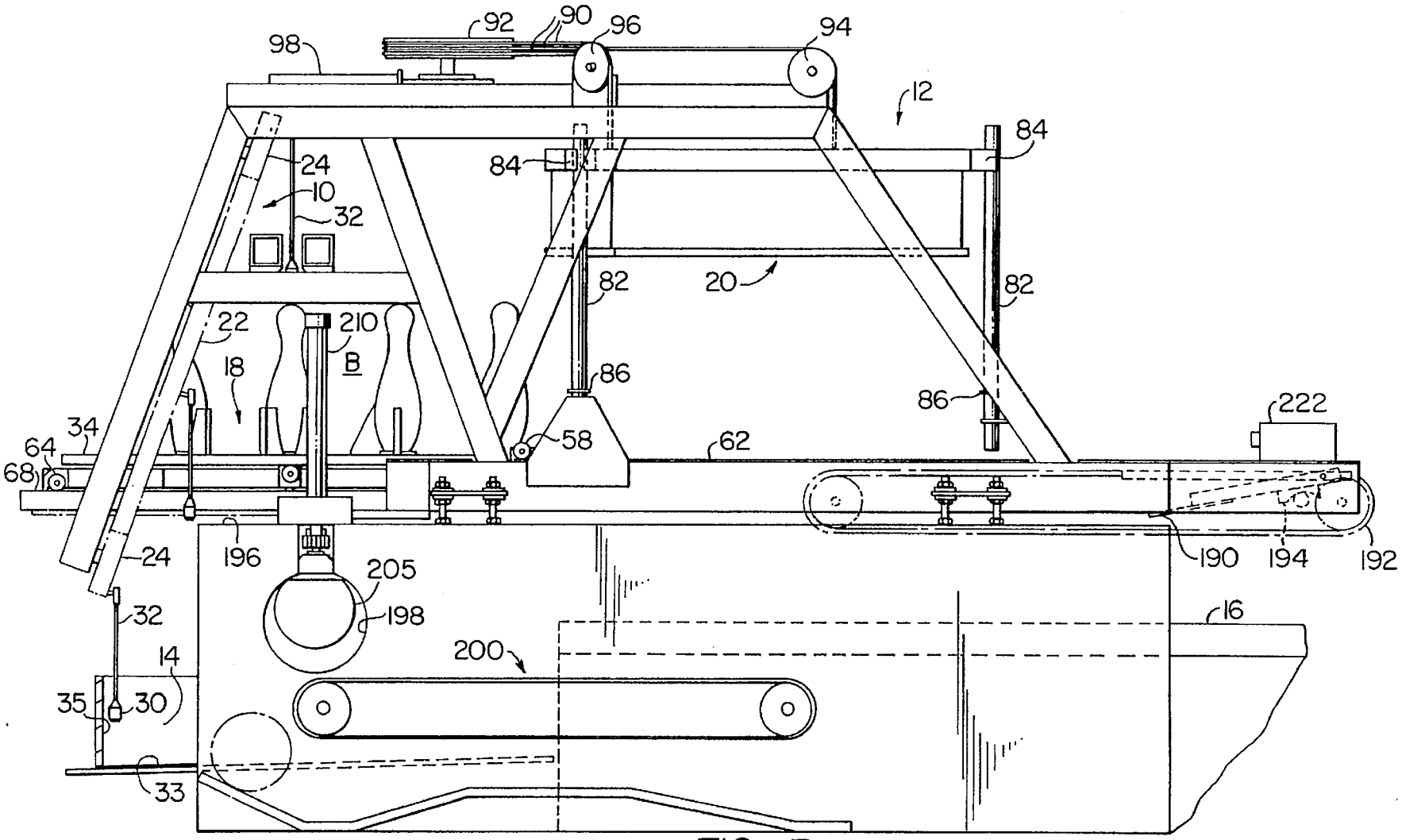
FIG. 3 is a partially schematic side view of the pinsetter of FIGS. 1 and 2.
Figure 4:
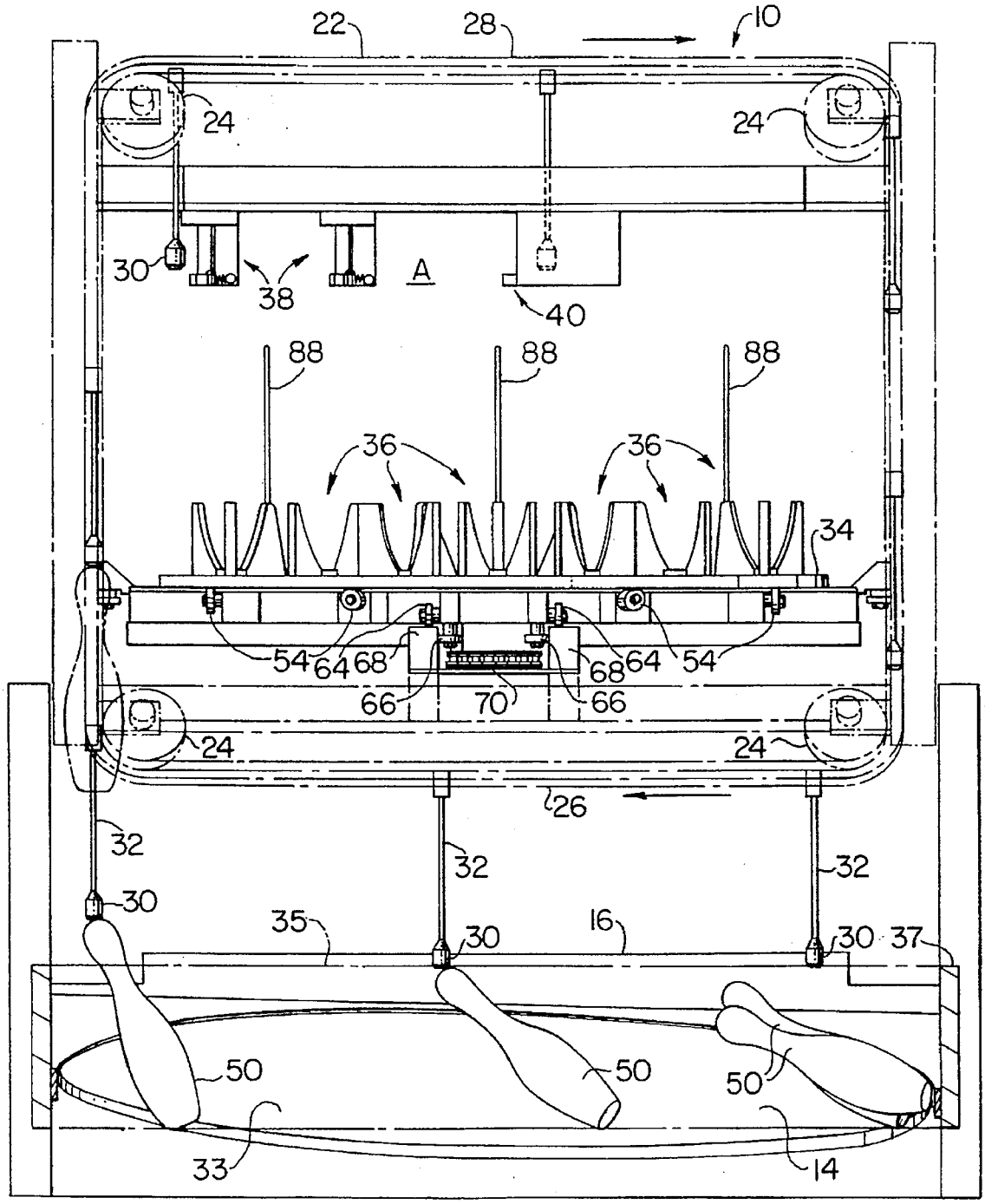
FIG. 4 is a rear end elevational view of the automatic pinsetter.

Reverting now to the elevator mechanism 10 and with particular reference to FIGS. 3 and 4, it will be observed that the elevator mechanism comprises an endless conveyor which may comprise a chain or belt but is shown in the form of a sprocket chain 22 which extends generally vertically from a loading station D adjacent the pit area to the pin discharge station A. More particularly, the conveyor chain 22 is arranged in a generally rectangular configuration viewed from the rear of the pinsetter and is provided with four (4) sprockets 24,24 at its corners. The conveyor may be driven, for example, by a direct current electric motor operatively associated with one of the sprockets 24,24 and, as illustrated, the conveyor progresses in a clockwise direction with a leftwardly moving substantially horizontal lower run 26 and a rightwardly moving substantially horizontal upper run 28. As best illustrated in FIG. 3 the conveyor is inclined forwardly above the pin discharge station A to provide clearance for depending magnets 30,30 to be described hereinbelow:

Both the elevator mechanism 10 and the pinsetting mechanism 20 employ magnetic means for lifting, manipulating, and transporting magnetically responsive bowling pins, the pins preferably being magnetically responsive at upper end portions thereof. Further, in the embodiment of the invention illustrated in FIGS. 3 and 4, permanent magnets 30,30 are employed and each magnet is supported by a flexible line 32 attached at an upper end to the conveyor and carrying the depending magnet 30 at its lower end. Between five (5) and nine (9) magnets and support lines are provided in substantially equally spaced relationship along the conveyor chain 22 and, more particularly, eight (8) such magnets and flexible support lines are illustrated in FIGS. 3 and 4. As the magnets 30,30 move leftwardly along the lower run 26 of the conveyor 22 through the pin loading station D in the pit area 14, the magnets tend to "seek" or "fish" for and pick-up bowling pins residing in indiscriminate orientation in the pit area 14. That is, the flexible lines 32,32 allow the magnets to move in a generally horizontal plane whereby to seek and attach to the head of a bowling pin therebeneath.

Figure 2:
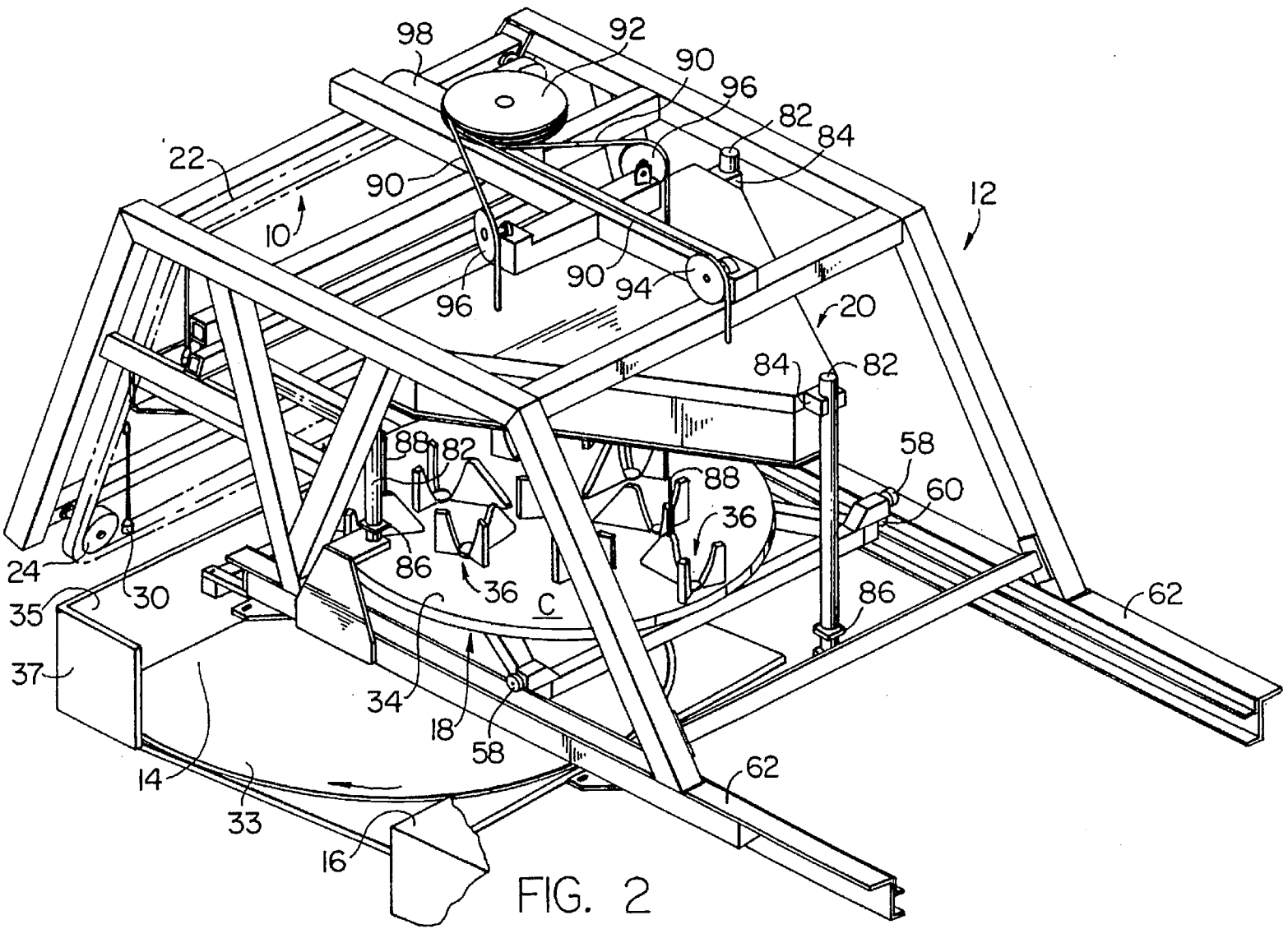
FIG. 2 is a further perspective view similar to FIG. 1 but showing a transfer mechanism in the pinsetter at a delivery station beneath a pinsetting mechanism.

Referring particularly to FIG. 2, it will be observed that a rotary table 33 is provided in the pit area 14 adjacent the rear end portion of the bowling alley 16. The table 33 rotates in a clockwise direction in FIG. 2 and accepts bowling balls and fallen bowling pins from the rear end portion of the bowling alley 16. The table 33 has a slight downward inclination toward the left as viewed from the front in FIG. 2 whereby to cause bowling balls to roll leftwardly for a purpose to be described hereinbelow.

In its clockwise rotation, fallen bowling pins are carried rearwardly into engagement with a barrier means which serves to obstruct the movement of the pins on the table and to thus provide for collection of the pins and the establishment of the pin loading or pick-up station D. As best illustrated in FIG. 2, the barrier means takes the form of a vertical rear wall 35 which extends transversely over a rear portion of the table 33 and a short connected side wall 37 forming a corner with the wall 35. As will be apparent, the bowling pins tend to collect in the corner deigned by the walls 35,37 and will reside in indiscriminate orientation in the corner at the loading or pick-up station D, FIG. 4. Preferably a number of additional or surplus pins are provided so that there will always be sufficient pins on the rotary table 33 for pick-up by the magnets 30,30 and for delivery of the same to the transfer mechanism 18, the pins thus being held in readiness in bowling array on the transfer mechanism for immediate delivery to the pinsetting mechanism when the rear end portion of the bowling alley has been cleared of bowling pins.

As best illustrated in FIGS. 3 and 4, the pin discharge station A is located above and in spaced relationship with the bowling alley. More particularly, the pin discharge station A resides beneath the upper horizontal run 28 of the conveyor 22 and above the transfer mechanism 18 and a rotary indexible table 34 which forms a part of the transfer mechanism. The table 34 is provided with a plurality of upwardly open cradles 36,36 for receiving and holding bowling pins in upright attitude. When the desired bowling array comprises ten (10) bowling pins in a conventional triangular arrangement, ten (10) cradles are, of come, provided as illustrated in conventional triangular arrangement, FIGS. 5 and 6.

Reverting now to the pin discharge station A, at least one gate 38 is provided at the station and is operable to cause bowling pins to be discharged from the conveyor 22 to the transfer mechanism 18 and, more specifically, to the cradles 36,36 on the rotary table 34. When ten (10) pins and cradles are provided as in FIGS. 5 and 6, two (2) horizontally spaced apart gates 38,38 are provided adjacent and in alignment with the linear path of movement of the upper run 28 of the conveyor 22. Further, a fixed stop 40 is also preferably arranged above the center of the table 34. Both the gates 38,38 and the fixed stop 40 operate to disengage and thus discharge bowling pins from their magnets 30,30 by obstructing the rightward movement thereof as the associated magnet continues to move and thereby causing the bowling pin to disengage and fall from its magnet into a cradle 36 positioned therebeneath.

Figure 7:
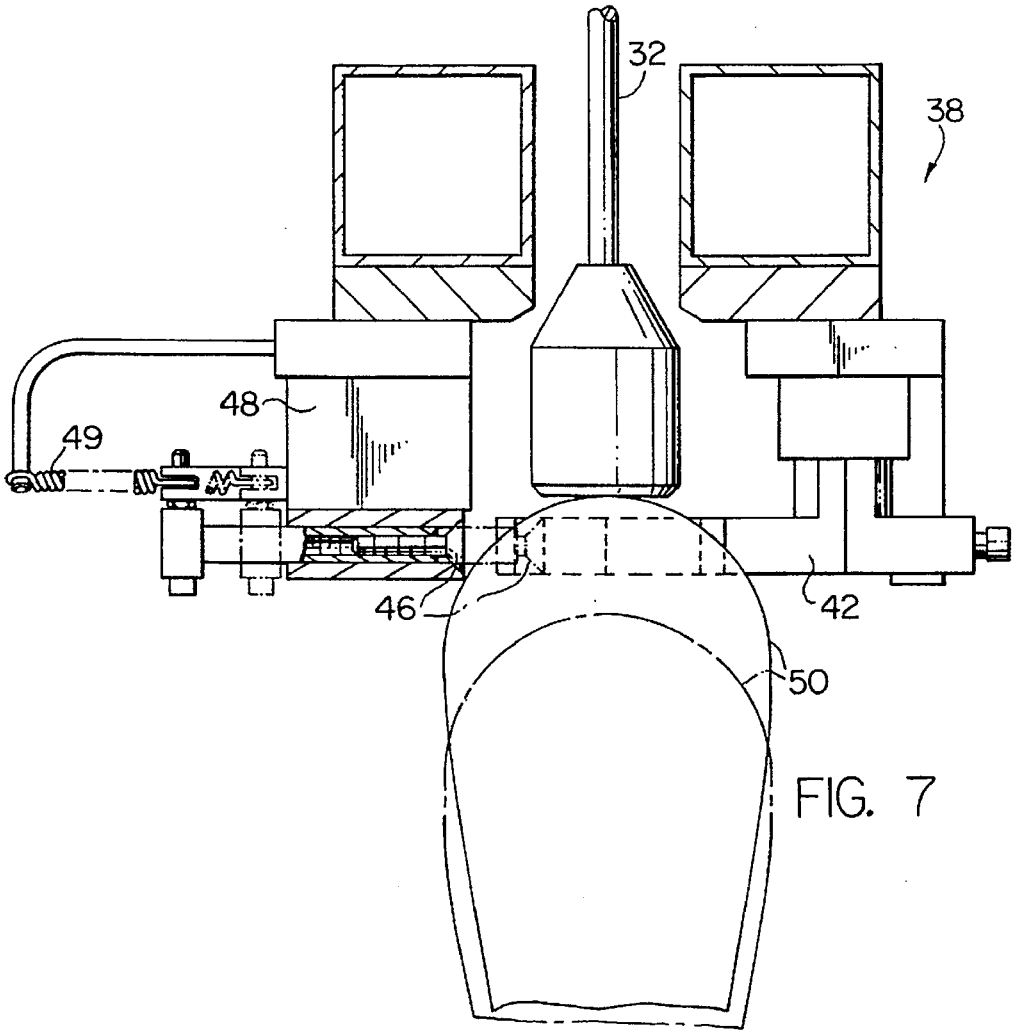
FIG. 7 is an enlarged fragmentary elevational view of a gate operable at a pin discharge station.
Figure 8:
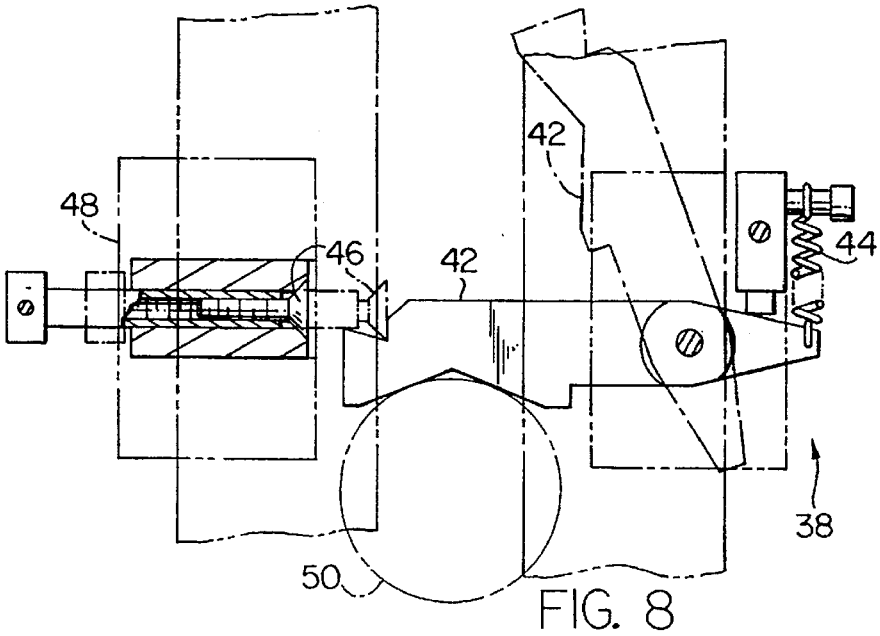
FIG. 8 is an enlarged top view of the gate of FIG. 7.

As best illustrated in FIGS. 7 and 8, a representative gate 38 has a swingable gate member 42 shown in operative or pin obstructing position in full line in FIG. 8 and in broken line in its inoperative or open position. A bias spring 44 urges the gate member 42 to it operative position for latching engagement by a plunger 46 shown in operative position in broken line and retracted or inoperative position in full line. The plunger 46 is operated by a solenoid 48 and a bias spring 49 so as to be moved to its broken line operative or latching position in FIG. 8 and to be retracted to its full line inoperative position in FIGS. 7 and 8. In its operative or latching position, a front end portion of the plunger 46 engages the gate member 42 and prevents the same from swinging open in a clockwise direction so as to accommodate the free passage of a bowling pin through the gate assembly 38.

Figure 5:
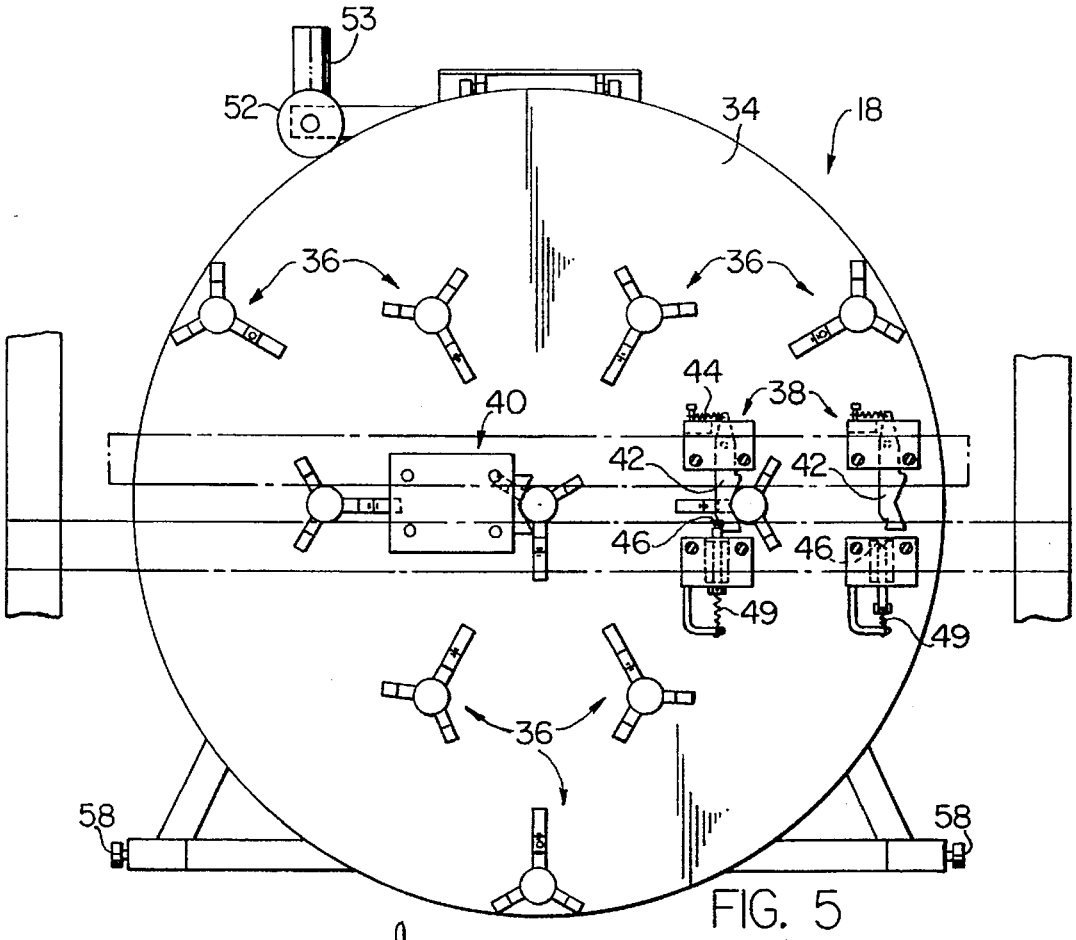
FIG. 5 is a top view of a rotary indexible table forming a part of a transfer mechanism.
Figure 6:
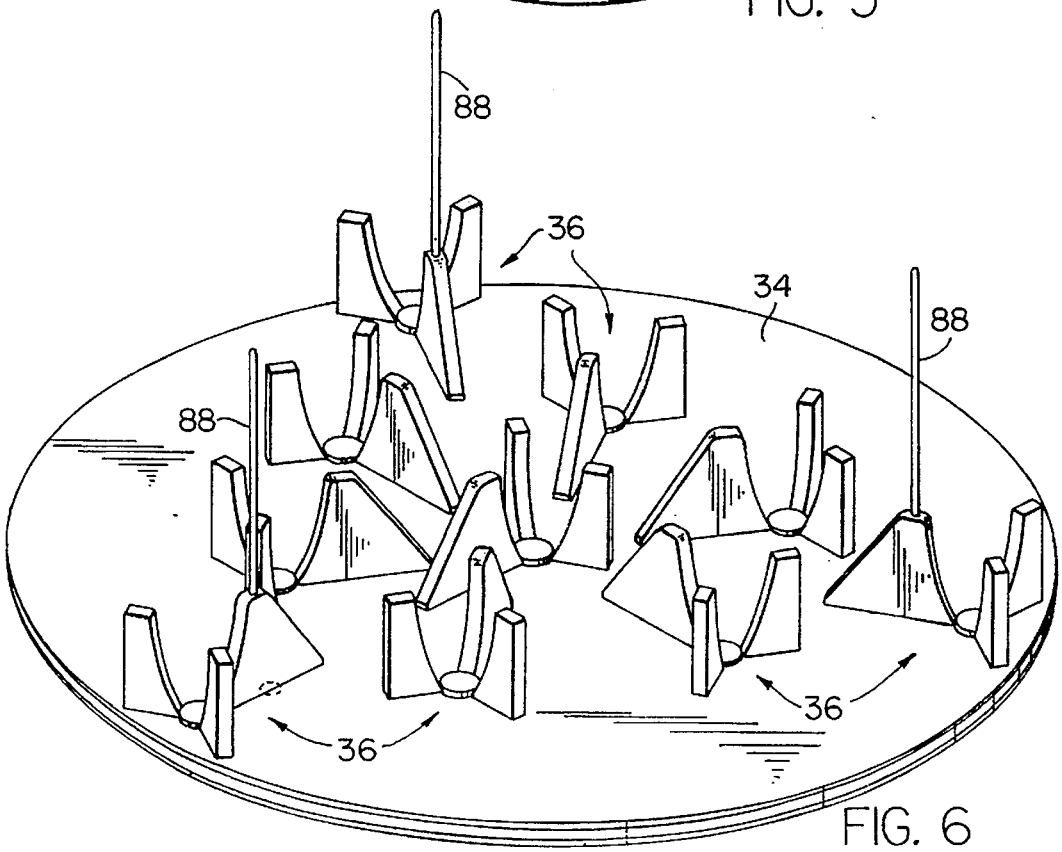
FIG. 6 is a perspective view of the rotary indexible table of the automatic pinsetter.

As will be apparent, the gates 38,38 and the indexible rotary table 34 can be readily operated in timed relationship so as to fill each of the cradles 36,36 on the table with a bowling pin. In FIG. 5 the rotary table 34 resides at an index position where a cradle 36 beneath the left-hand gate 38 is positioned so that a bowling pin can be disengaged from its magnet and dropped vertically into the cradle. Accordingly, the left-hand gate 38 in FIG. 5 is closed so as to engage the head of a bowling pin such as a pin 50 in FIG. 7 and to cause the same to disengage from its magnet 30 and fall into the cradle 36. On opening of the left-hand gate 38 and with the table 34 remaining in the FIG. 5 position, the next succeeding bowling pin 50 will engage the fixed stop 40 and thus be discharged into the center cradle 36 therebeneath.

Still referring to FIG. 5, it will be observed that the table 34 can next be indexed through thirty degrees (30°) in a clockwise direction whereby to bring an outermost cradle 36 at a rear right-hand corner of the triangular arrangement beneath the right-hand gate 38. With the gate 38 closed the next succeeding bowling pin will engage the same, disengage from its magnet 30, and fall into the outermost cradle 36. A succeeding 30° clockwise indexing movement of the table 34 will bring the cradle 36 immediately to the left of the outermost cradle 36 in FIG. 5 to a loading position beneath the left-hand gate 38. Thus, in this index position of the table 34 the right-hand gate 38 is open and the left-hand gate 38 is closed, the next succeeding bowling pin engaging the left-hand gate 38 and falling into the cradle 36 therebeneath. The next indexing movement of the table 34 comprises a 60° clockwise movement whereby to bring the cradle 36 at approximately eleven o'clock in FIG. 5 beneath the left hand gate 38. As will be apparent, all of the cradles 36,36 will be filled on completion of nine (9) indexing movements of the table 34, eight (8) thirty degree (30°) and one (1) sixty degree (60°) indexing movement, with an additional 60° movement to bring the number one pin to the front position.

Indexing movements of the table 34 may be provided by a small drive roller 52 engaging the periphery of the table and operated, for example, by a direct current electric motor 53.

Figure 9:
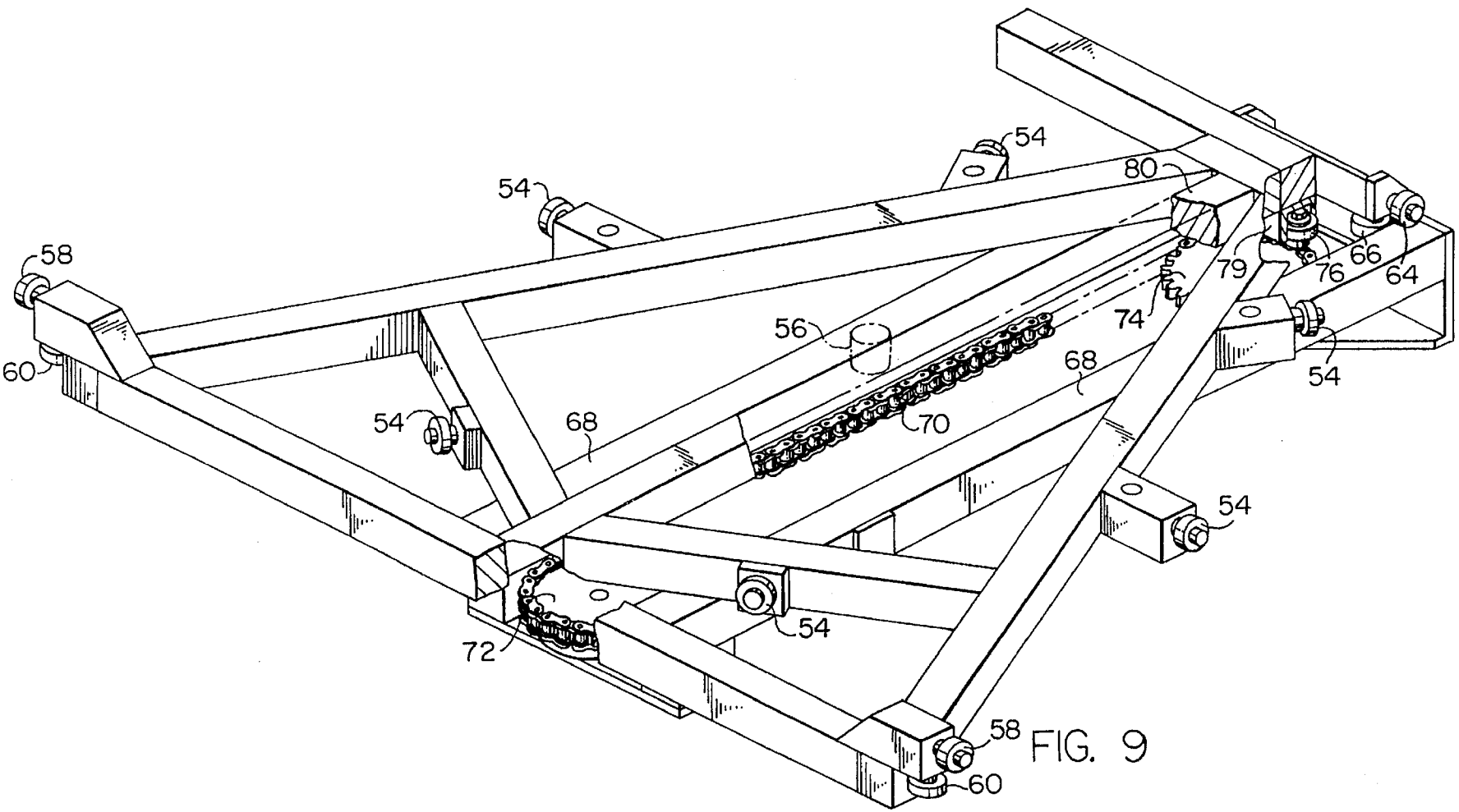
FIG. 9 is a perspective of a supporting structure for the rotary indexible table of FIGS. 5 and 6.

FIG. 9 illustrates a supporting structure for the table 34 which accommodates the rotary indexing movement thereof and which also provides for linear transfer of the table between its loading station B and its delivery station C. As illustrated, a supporting framework is provided with a plurality of small support rollers 54,54 for the table 34 together with a central stub shaft 56 about which the table rotates in its indexing movements. The framework of the supporting structure is provided with its own rollers 58,60 arranged at right angles and at opposite front end portions thereof for movement in one and an opposite direction along parallel front to rear frame members 62,62, FIG. 2. At a rear end portion of the structure right angularly arranged rollers 64,66, FIG. 4, move in one and an opposite direction along parallel frame members 68,68 of the pinsetter, FIG. 9. A chain 70 has an idler sprocket 72 at a front end portion and a drive sprocket 74 at a rear end portion with a small connecting link 76 between the chain 70 and element 79 of the supporting structure.

As will be apparent, a drive means such as a direct current electric motor, not shown, may be connected with the rear sprocket 74 to drive the sprocket chain 70 and thereby cause the table support frame and the table 34 to be moved from the loading station B to the delivery station C, FIG. 3. At the delivery station C the rotary table 34 is in precise vertical alignment with the desired location of the bowling array on the bowling alley 16 therebeneath. Further, the pinsetting mechanism 20 is moveable vertically in precise vertical alignment with the table 34 and the desired location of the bowling array on the bowling alley, an uppermost position of the pinsetting mechanism being above and in spaced relationship with the delivery station C, FIG. 2.

As best illustrated in FIGS. 1 and 2, the pinsetting mechanism 20 takes a generally triangular configuration viewed from above and is supported for vertical movement by three (3) vertically extending rods 82,82. That is, slide members 84,84 mounted on the pinsetting mechanism 20 and engaged with the rods 82,82 provide for the precise vertical sliding movement of the mechanism 20. Stops 86,86 on the slide rods 82,82 cooperate with the slide members 84,84 to establish a precise lowermost or discharge position of the pinsetting mechanism for depositing pins on the bowling alley 16. A first raised or intermediate position of the pinsetting mechanism above the rotary table 34 may be established by vertically extending stop members 88,88 on the table 34, FIGS. 2, and 6.

The pinsetting mechanism 20 also has a second raised or uppermost position as illustrated in FIGS. 1, 2, and 3 above the table 34 when the latter is at its delivery station C. As will be apparent, bowling pins engaged and lifted from the cradles of the table 34 by the pinsetting mechanism are held above the table during a return or rearward movement of the table to its loading station. The pinsetting mechanism may thereafter be lowered to its aforementioned lowermost position for deposit of the pins on the bowling alley.

The means for raising and lowering the pinsetting mechanism may vary widely within the scope of the invention but in the presently preferred form comprises a plurality three (3) cables 90,90 operated by a drive pulley 92 and extending over idler pulleys 94 and 96. A single idler pulley 94 is disposed above a front end portion of the pinsetting mechanism 20 for attachment of a cable depending from the pulley to a front end portion of the mechanism. A pair of spaced pulleys 96,96, FIG. 1, are provided over the rear corner portions of the pinsetting mechanism 20 so that cables 90,90 can extend downwardly therefrom for attachment to the mechanism. Drive means for the pulley 92 may take the form of a direct current electric motor 98. As will be apparent, operation of the motor in one and an opposite direction wig result in the required vertical movement of the pinsetting mechanism to and from the aforesaid three positions.

Figure 10:
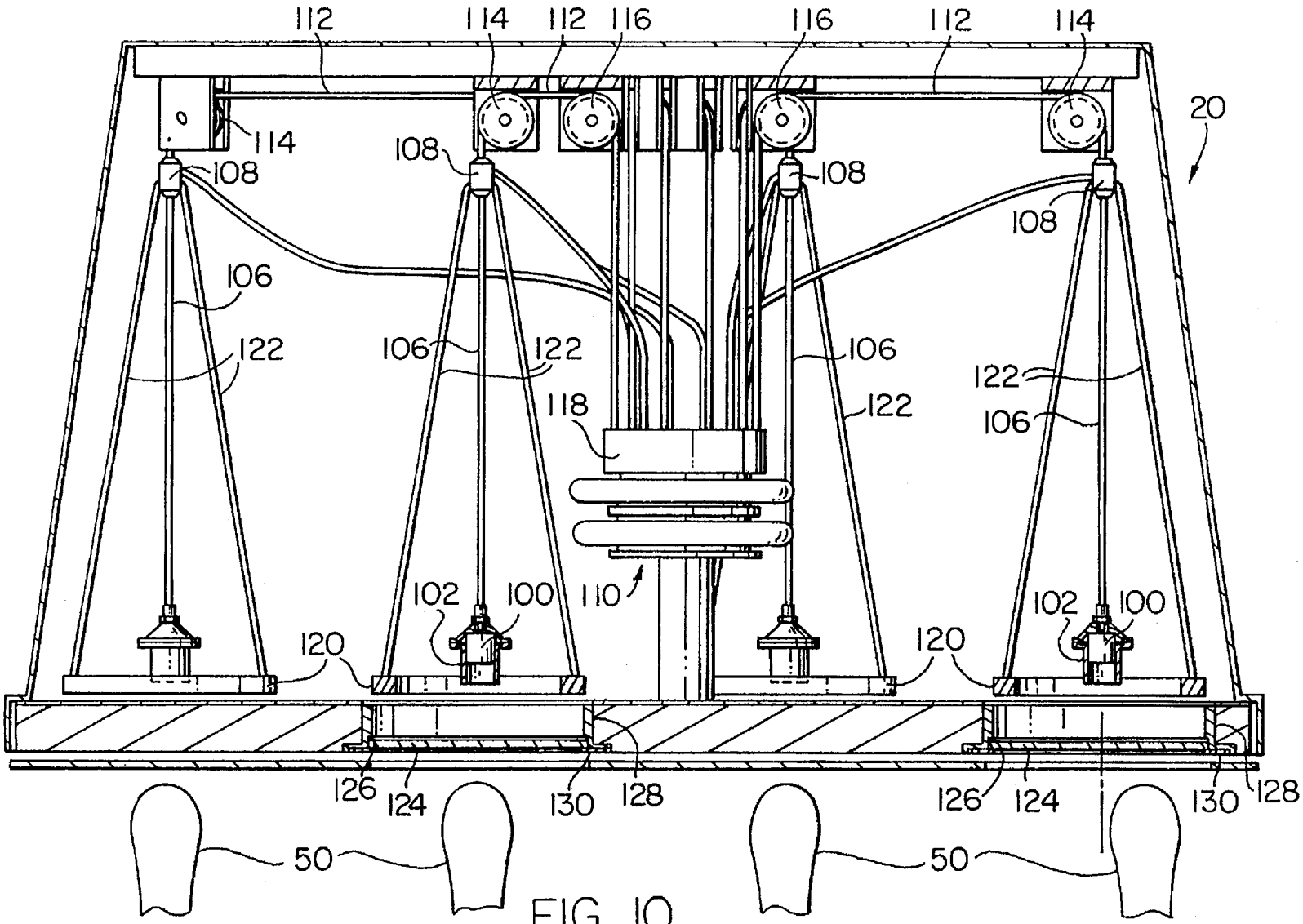
FIG. 10 is an enlarged sectional view in elevation of a first form of a pinsetting mechanism.
Figure 11:
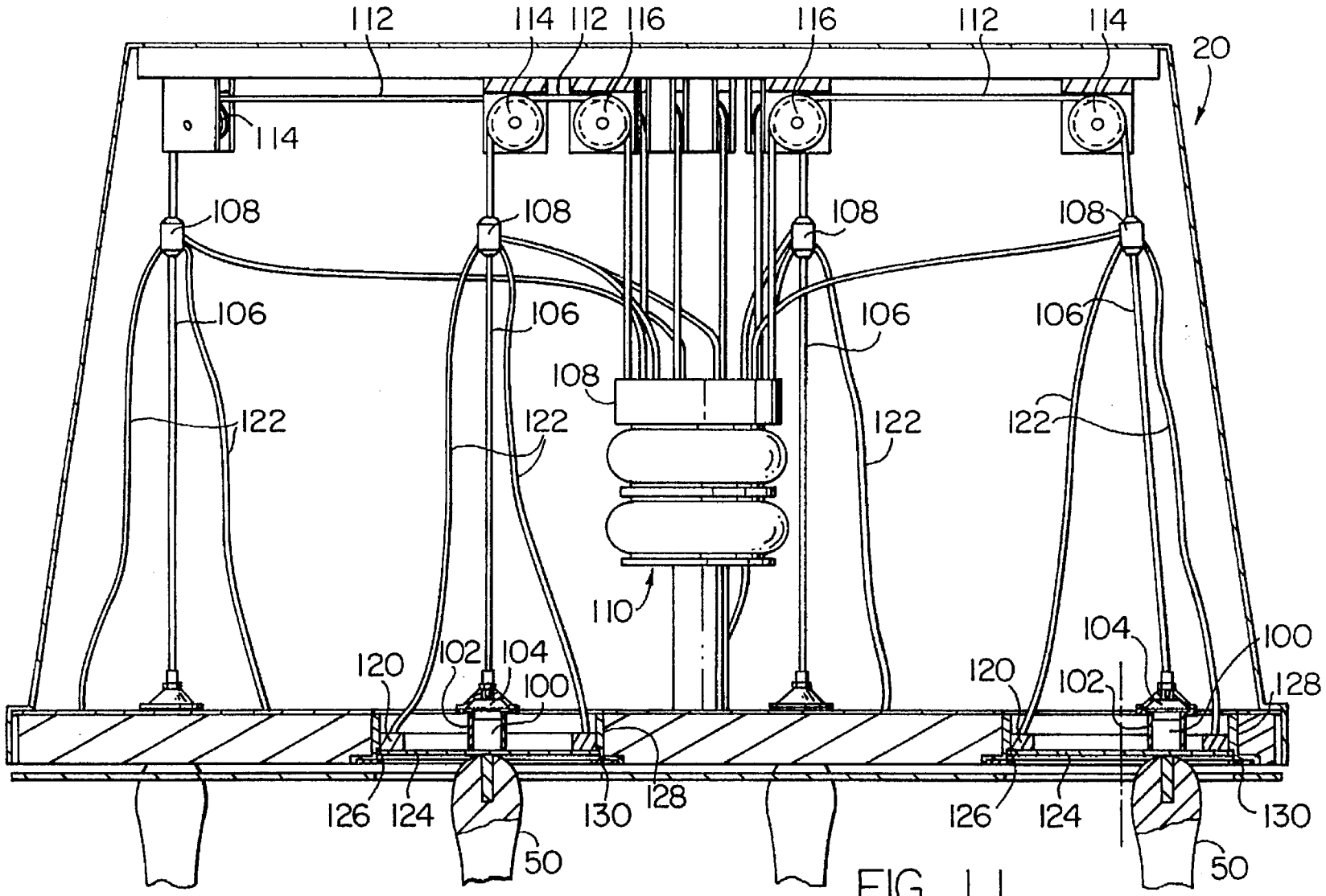
FIG. 11 is a view of the pinsetting mechanism of FIG. 10 but with the elements thereof in different operating positions.

In accordance with the present invention, the pinsetting mechanism includes a plurality of magnets in substantially co-planner horizontal arrangement and in bowling array corresponding precisely with that of the cradles on the rotary table and the bowling alley therebeneath. When there are ten (10) bowling pins in conventional triangular arrangement, the pinsetting mechanism 20 includes ten (10) magnets in precisely the same arrangement with two (2) such magnets being illustrated at 100,100 in FIGS. 10 and 11. Each of the magnets 100 has a small casing 102 associated therewith which defines a vacuum chamber 104 thereabove and which has a vacuum line connected therewith and supporting the casing and the magnet. The vacuum lines 106,106 extend to small connector elements 108,108 and then, to an actuator 110. The actuator 110 serves both to selectively evacuate the chambers 104,104 and to raise and lower the connectors 108,108 whereby to raise and lower the casings 102,102 and their magnets 100,100. Extending upwardly from each connector 108 is a support line 112 which has associated pulleys 114 and 116 and which is connected to a manifold 118 at an upper end portion of the actuator 110. As will be apparent, the actuator 110 may be expanded as illustrated in FIG. 11 whereby to allow the support lines 112,112 to move upwardly at the manifold 118 and thus to allow the magnets 100,100 and casings 102,102 to move downwardly to the position shown in FIG. 11. On contraction of the actuator 110, as illustrated in FIG. 10, the lines 112,112 are drawn downwardly by the manifold 118 whereby to elevate the casings 102,102 and the magnets 100,100 as illustrated. As also illustrated in FIG. 10, the magnets 100,100 are moved upwardly within their casings 102,102 by evacuation of the chambers 104,104 in the casings. Evacuation is accomplished through the vacuum lines 106,106 and by operation of the actuator 110, a vacuum chamber within the manifold 118 connecting the lines 106,106 to a vacuum generator, not shown. The connectors 108,108 also carry annular weights 120,120 which are supported by a plurality of lines 122,122 extending therefrom to the connectors. The weights 120,120 serve as downward biasing means for separator means in the form of small plates 124,124. The plates 124,124 are arranged for limited vertical movement between the lower positions shown in FIG. 10 and the upper positions shown in FIG. 11. Shoulders 126,126 formed on annular support members 128,128 for the plates 124,124 limit the upward movement thereof. Downward movement of the plates is limited by annular members 130,130 therebeneath.

Referring again to FIGS. 10, 11, and 12, the operation of the pinsetting mechanism will be apparent. In FIG. 10, the pinsetting mechanism is moving downwardly above an array of bowling pins 50,50. Such movement may occur with pins on the rotary table 34, or with the pins on the bowling alley 16. The actuator 10 is in its contracted position with the magnets 100,100 raised within their casings 102,102. The biasing weights 120,120 are also elevated above the separator plates 124,124.

In FIG. 11, the pinsetting mechanism has descended to its pin engaging and pick-up position either above the rotary table 34 or the bowling alley 16. The heads of the bowling pins 50,50 are now in engagement with the separator plates 124,124 urging the plates upwardly and the weights 120,120 have descended to their biasing position atop the plates 124,124. In this position of the separator plates and weights, the plates serve to steady the bowling pins therebeneath prior to the full influence of the magnets on the heads of the pins. That is, when the magnets 100,100 and casings 102, 102 initially descend to the FIG. 11 position atop the separator plates, the magnets are at first retained in their upper positions as in FIG. 10. In their upper positions, the magnets may exert a limited degree of magnetic influence, short of their full influence, and will tend to "seek" the heads of bowling pins therebeneath and on the opposite sides of the separator plates. Thus, the right hand bowling pin in FIG. 11 is displaced from the center of its separator plate 124 and may be said to be in an "off spot" position. That is, the pin may constitute a remaining upright pin after a first bowling ball has been released by a bowler with the pin having been jostled so as to be moved slightly from its spot on the bowling alley but with insufficient force exerted on the pin to topple the same.

As will be apparent in FIG. 11, the associated magnet 100 and casing 102 move laterally from the center of the separator plate rather than causing the pin to tilt or otherwise displacing the pin as might occur if the full influence of the magnet were exerted immediately upon the pin. Thus, when the actuator 110 has completed its movement and has released the vacuum in the chamber 104 of the casing 102, the magnet 100 descends to the FIG. 11 position now exerting its full influence on the "off spot" bowling pin 50 therebeneath and, on subsequent elevation of the pinsetting mechanism the magnet raises the pin in the "off spot" position. When fallen bowling pins have been subsequently cleared from the bowling alley therebeneath, the pinsetting mechanism may again be lowered to its lowermost or discharge position whereupon the right hand pin 50 will be deposited on the bowling alley in precisely the same "off spot" position occupied prior to raising of the same. As will be seen, the sequential operation of the actuator in first lowering the magnets and casing with the magnets elevated within the casings by evacuation of the chambers in the casings, followed by the downward release of the magnets is important in the efficient handling of "off spot" bowling pins. Operation is identical for the magnet and casing second from the left in FIG. 11 but with the bowling pin remaining centered or on "spot" the magnet merely drops vertically within its casing to exert its full influence on the bowling pin with no "seeking" operation necessary during the instantaneous upward retention of the magnet in its casing.

It will also be apparent from the foregoing that a similar result can be achieved without the use of vacuum generating means and the vertical sliding movement of magnets 100, 100 in their casings 102,102. Merely by employing a very slow increment of final downward movement of the magnets or, perhaps in instantaneous stop and go movement of the magnets in close proximity to the separator plates, the magnets can be caused to "seek" the head of an "off spot" bowling pin prior to engagement with the separator plates and thus avoid tilting or otherwise displacing such bowling pins.

The foregoing operation may, of course, occur in elevating a full complement of ten (10) bowling pins above a table 34 at its delivery station and thereafter depositing the pins on the bowling alley. Similarly, when a first ball has been thrown by a bowler, and when one or more bowling pins remain upright, the pinsetting mechanism may be lowered to its lowermost position whereupon the heads of such remaining pins will be engaged as illustrated in FIG. 11, gripped and held magnetically for elevation of the same by subsequent upward movement of the pinsetting mechanism. Upon clearing of the bowling alley of fallen bowling pins, the pins may be deposited or reset on the bowling alley and as explained, precise resetting of the pins will be achieved.

The release of bowling pins by the magnets 100,100 may also be accomplished by a variety of other means for causing limited vertical movement of the magnets relative to the heads of the pins and the separator plates 124,124. That is, the magnets 100,100 and their casings 102,102 may be elevated by the lines 106,106 whereby to cause the separator plates to engage the shoulders 126,126, thus limiting upward movement of the separator plates and, on continued upward movement of the magnets and casings, first reducing and then eliminating the influence of the magnets on the heads of the bowling pins. It should also be noted that the separation and release of the bowling pins can be accomplished by a judicious combination of physical movement of the magnets by the lines 106,106 and evacuation of the chambers 104,104 in the magnet casings 102,102. That is, the actuator 110 and its associated vacuum generator may be operated to evacuate the chambers 104,104, whereby to raise the magnets 100,100 within their casings absent upward movement of the lines 106,106. On elevation of the magnets 100,100 within the casings 102,102 and on reduction of the magnetic influence thereof with respect to the heads of the bowling pins 50,50, the pinsetting mechanism 20 may be elevated with the pins released and deposited therebeneath. Accordingly, raising the lines 106,106 alone, evacuating the chambers 104,104 alone, or a combination of both such actions may be employed in releasing bowling pins from the magnets 100,100.

FIGS. 13 through 16 illustrate the pinsetting mechanism and its magnet, separator means etc. in the presently preferred form. The aforementioned cables 90,90, are attached within pinsetting mechanism **20*a* to a frame member 132 first extending about small pulleys 134,134 mounted on a carrier 136 which is moveable vertically within the pinsetting mechanism. That is, the three (3) cables 90,90, One shown, have associated respectively therewith three (3) pulleys 134,134 arranged in horizontally spaced relationship within the pinsetting mechanism 20*a* and with the cables extending thereabout and fixedly connected to frame members, one shown, such as the member 132. Ten (10) magnet assemblies indicated generally at 138, one shown, are supported in common by the carrier 136 for vertical movement therewith relative thereto, and with the pinsetting mechanism 20*a***.

Each of the magnet assemblies 138 includes a small container 140 at least partially filled with a liquid 142 and containing a magnet 144 equipped with a float means 146. The container 140 is provided with a cover 148 and is slidable vertically within a sleeve 150. The sleeve 150 has an annular flange 152 at an upper end portion with biasing means in the form of one or more springs 154, one shown urging the flange and sleeve downwardly. Adjustment springs 156,156 are also operatively associated with the springs 154,154 in the embodiment shown. A separator plate 158 is provided beneath the container 140 and is engageable by the sleeve 150 at a lower end portion of the latter.

Figure 13:
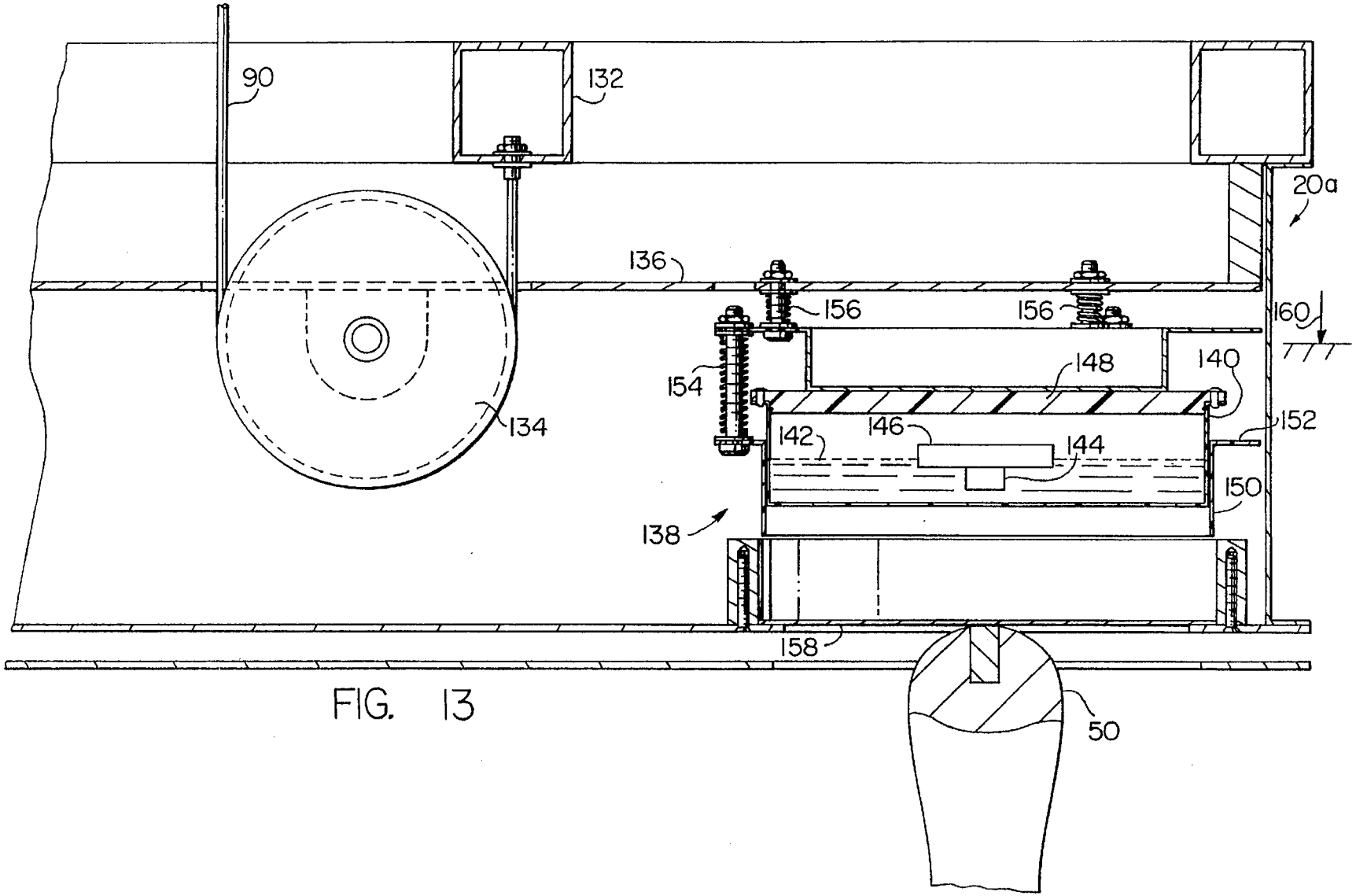
FIG. 13 is an enlarged fragmentary vertical sectional view of a portion of a second embodiment of a pinsetting mechanism.
Figure 14:
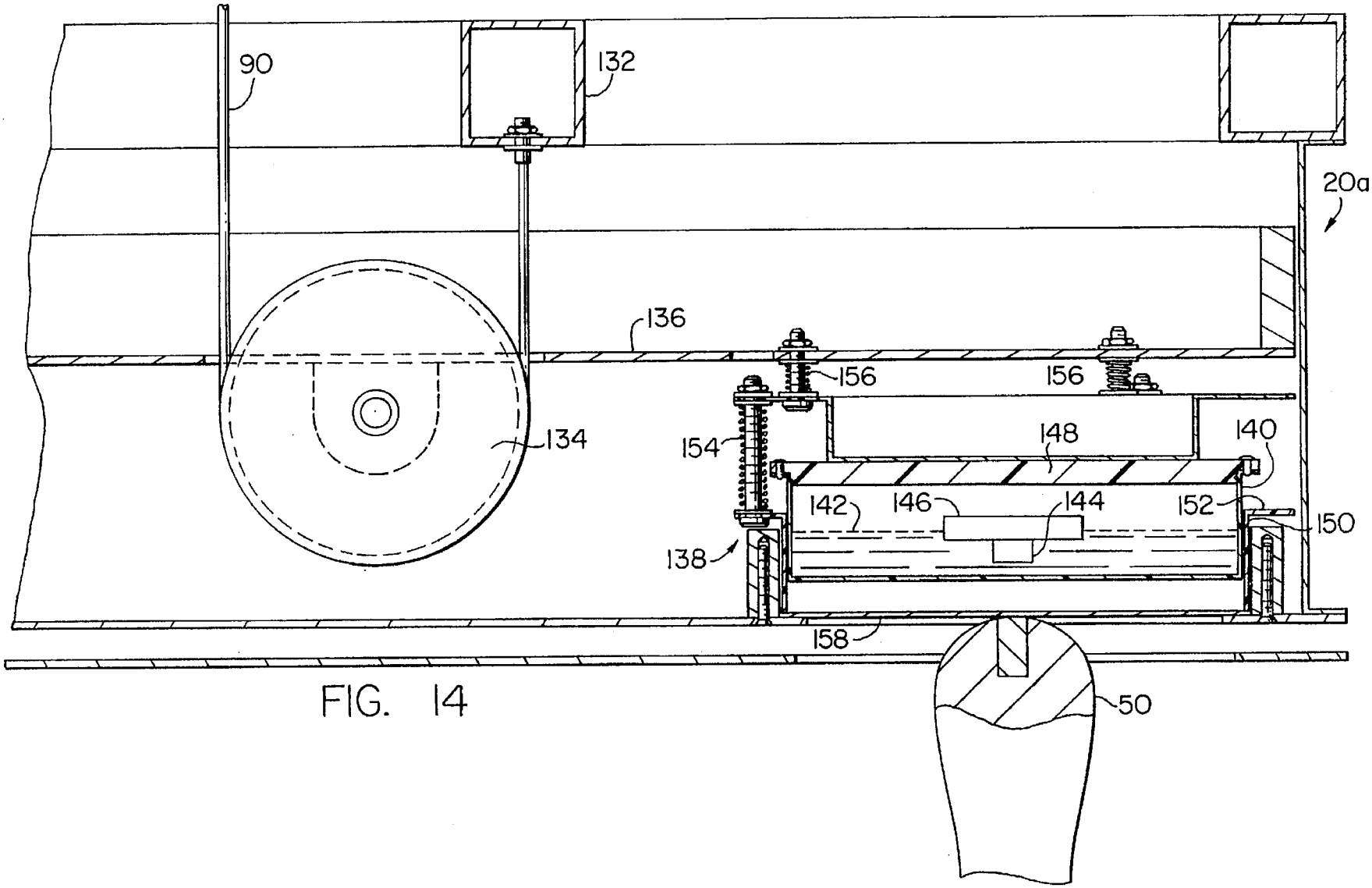
FIG. 14 is a view similar to FIG. 13 but with the elements of the pinsetting mechanism in a different operating position.
Figure 15:
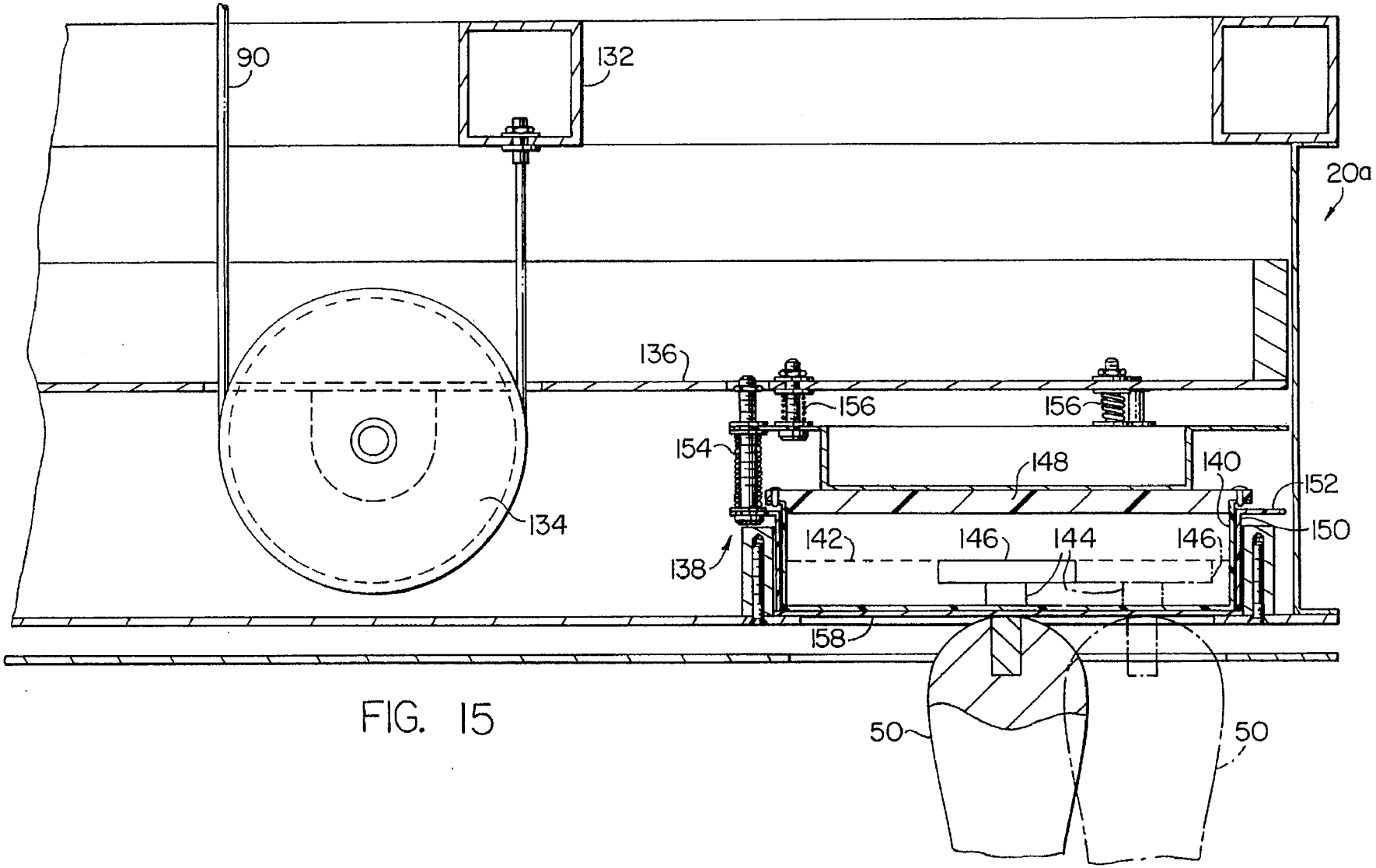
FIG. 15 is a view similar to FIG. 13 but with the elements of the pinsetting mechanism in a different operating position.
Figure 16:
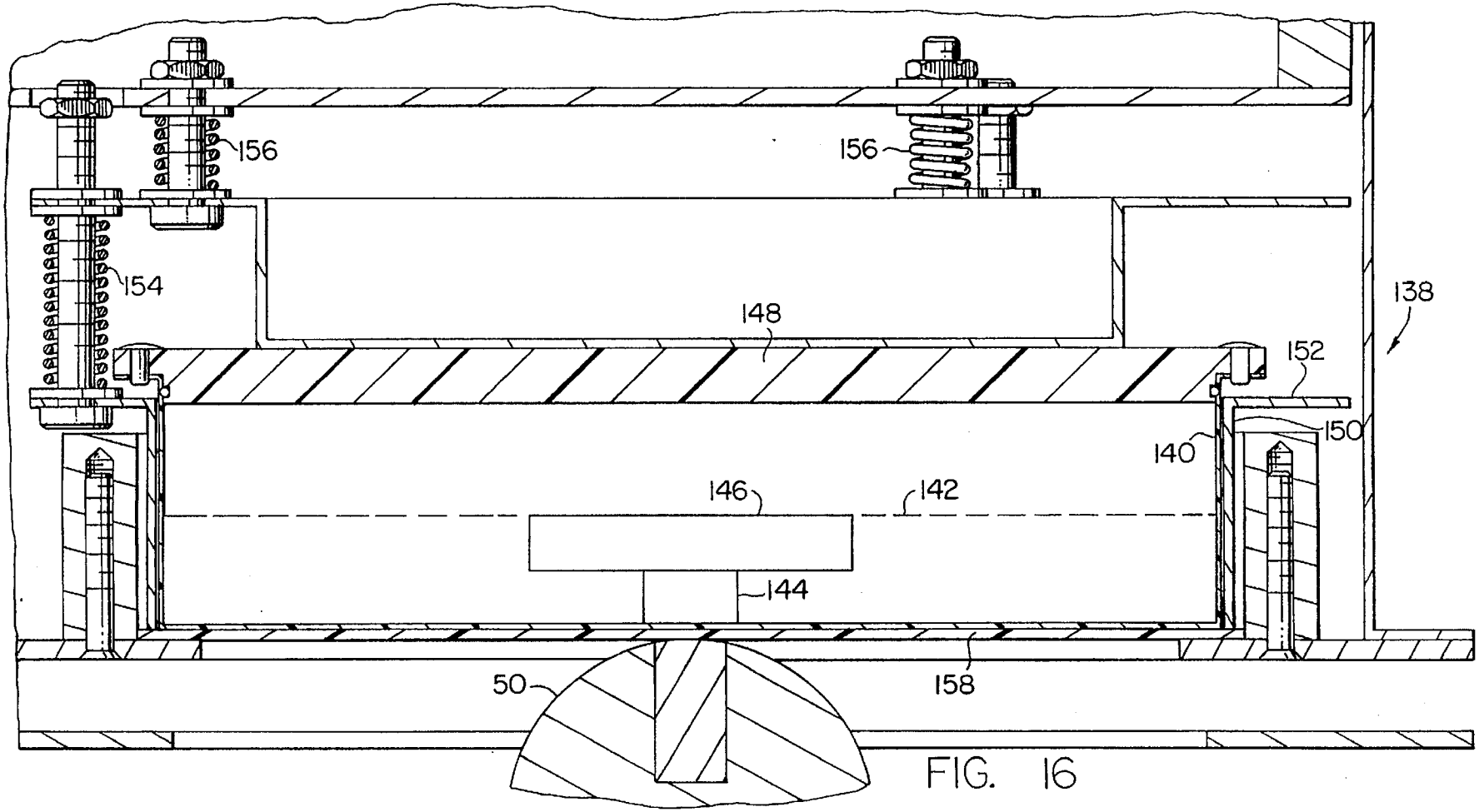
FIG. 16 is a further enlarged view of the mechanism of FIG. 15 with the elements in like position.

Referring now to FIG. 13, it may be assumed that the pinsetting mechanism **20*a* has reached a limit of downward travel as illustrated by the arrow 160. That is, the pinsetting mechanism may have reached a stop as described above in downward movement above the rotary table 34 or in downward movement above the bowling alley 16. Limited continued downward movement of the cables 90,90 will now allow the carrier 136 to move downwardly within the pinsetter carrying the magnet assemblies 138,138 therewith. Thus, magnet assembly 138 will operate as illustrated in FIGS. 13 and 14, with the head of a bowling pin 50 in engagement with the separator plate 158, an initial steadying operation of the separator plate on the bowling pin being thus achieved. In FIG. 14, container 140, in its downward movement within the sleeve 150, remains in spaced relationship above the separator plate 158 but the sleeve 150 resides in engagement with the separator plate and serves to bias the same downwardly at the urging of the biasing springs 154,154. On further downward movement of the carrier 136 and the magnet assembly 138 to the FIG. 15 position, the container 140 reaches the lower limit of its travel and engages the separator plate 158 as illustrated. The magnet 144 in the container thereupon moves downwardly overcoming the upward biasing force of its float 146 and engages the bottom of the container 140 whereby to magnetically grip and hold a bowling pin 50 beneath the separator plate 158. The bowling pin 50, shown in full line in FIG. 15, may be regarded as an "on spot" bowling pin whereas the bowling pin 50 shown in broken line may be regarded as an "off spot" bowling pin. Thus, when an "off spot" bowling pin is encountered, magnet 144 and float 146 will move laterally in the liquid 142 in the container 140 to a broken line position in FIG. 15 whereby to magnetically grip and hold a bowling pin therebeneath without tilting or otherwise displacing the pin. Partial magnetic attraction occurring in FIG. 14 prior to the FIG. 15 position cause the magnet and float to move laterally as stated. The further enlarged view of FIG. 16 illustrates elements in the FIG. 15** position but with an "on spot" bowling pin only.

On reverse movement of the cables 90,90 in the upward direction, the foregoing sequence is of course reversed with the magnet assemblies 138 being carried upwardly by the carrier 136. In FIG. 14, it will be noted that the sleeve 150 retains the separator plate 158 in its lowermost position while the magnet 144 has been moved sufficiently upwardly to release its magnetic hold on the bowling pin 50 therebeneath. Continued upward movement of the carrier thereafter returns the magnet assembly 138 to the FIG. 13 position whereupon the carrier 136 engages the frame members 132,132 and the entire pinsetting mechanism **20*a*** is elevated as described.

Figure 18:
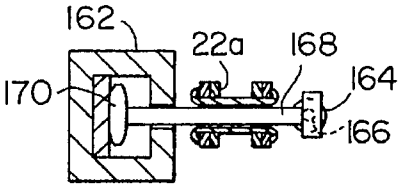
FIG. 18 is a sectional view taken generally as indicated at 18,18 in FIG. 17.
Figure 17:
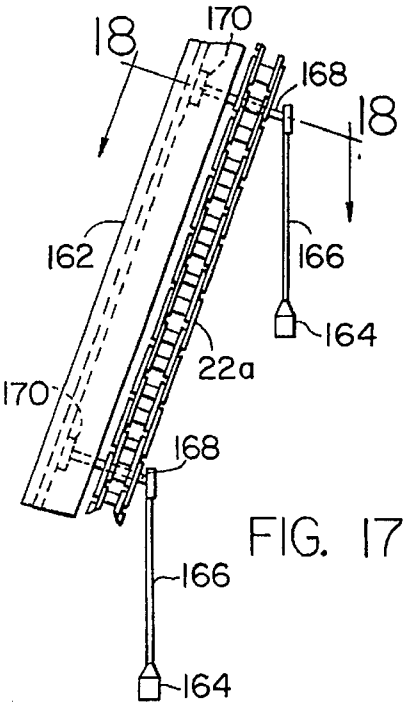
FIG. 17 is an enlarged fragmentary view of an alternative form of a conveyor employed in an elevator mechanism and incorporating electro-magnets.

The foregoing has dealt exclusively with the use of permanent magnets in the automatic pinsetter of the present invention but it will be obvious that electro-magnets can also be employed. FIGS. 17 and 18 illustrate the use of electro-magnets in the elevator mechanism of the present invention. Thus, a conveyor chain **22*a*, partially shown in FIG. 17, has an associated commutation track 162 which is also partially shown but which extends along and adjacent the conveyor chain throughout its length. Small electro-magnets 164,164 are suspended on flexible electrical conductors 166,166 from the chain 22*a*. Additional conductors 168,168 extend from the conveyor chain to the commutation track and may include T-shaped end portions 170,170 as illustrated in FIG. 18. With the T-shaped end portions 170,170 in sliding electrically conductive relationship in the commutation track 162 it will readily be understood that the electro-magnets 164,164 can be maintained in an energized state throughout their path of movement on the conveyor chain 22***a*. Construction and operation may be otherwise identical with the permanent magnet system described above.

Figure 12:
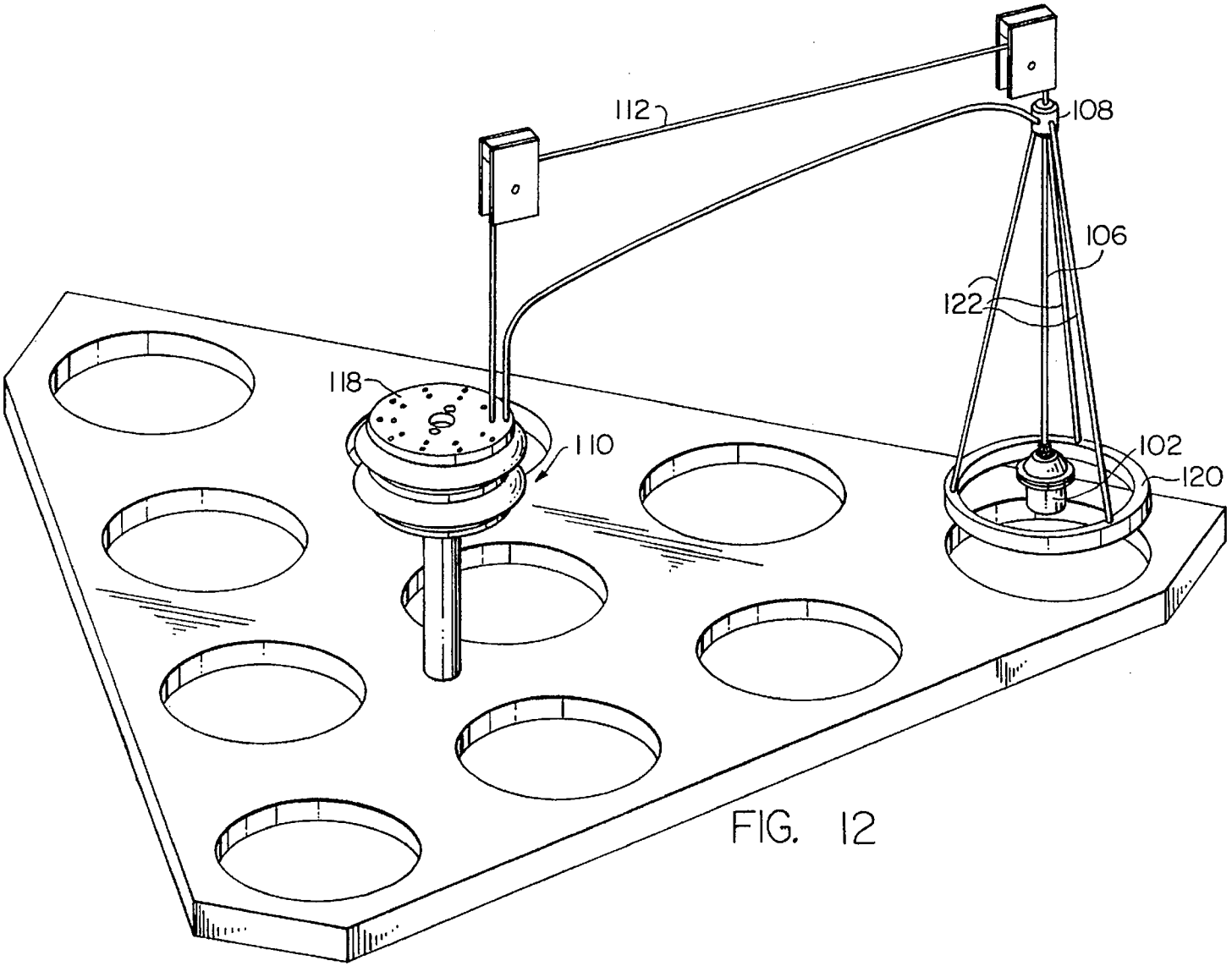
FIG. 12 is a perspective view of a portion of the pinsetting mechanism of FIGS. 10 and 11.
Figure 20:
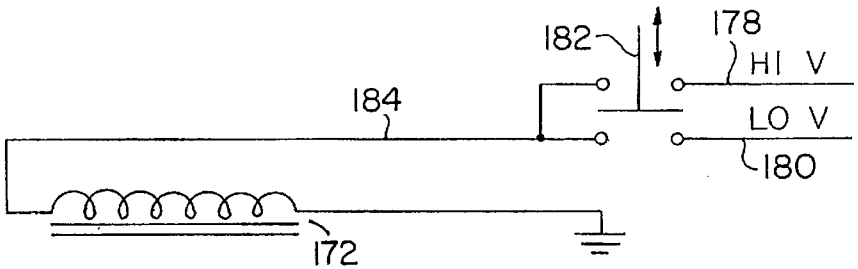
FIG. 20 is a schematic view of electrical connections for the electro-magnet of FIG. 19.
Figure 19:
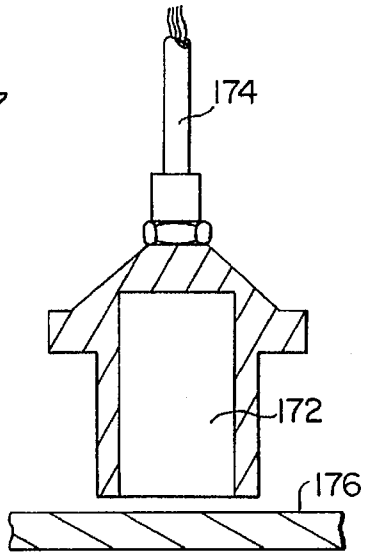
FIG. 19 is an enlarged fragmentary view of a single electro-magnet forming a still further embodiment of the magnet means in the pinsetting mechanism.

In FIG. 19, a small electro-magnet 172 is shown suspended from a flexible electrical conductor 174 in a pinsetting mechanism of the type illustrated in FIGS. 10 through 12. That is, vacuum lines 106,106 are replaced by flexible electrical conductors 174,174. Separator plates may be provided as at 176 in association with the magnets. As will be apparent, the magnets 172,172 may be energized and deenergized as required to magnetically grip and release magnetically responsive bowling pins. The electro-magnets 172, 172 may be moved vertically in the manner described for the permanent magnets above or, the variable influence of the magnets causing them first to "seek" the head of a sub-adjacent bowling pin and thereafter to magnetically grip the same can be accomplished merely by selectively connecting the magnets to a high and low voltage source as illustrated in FIG. 20. Thus, a magnet 172 has an associated high voltage source 178 and a low voltage source 180 with a switch 182 operable to selectively connect the electro-magnet 172 through a line 184 with the two voltage sources. The switch 182 also operates to disconnect the electro-magnet from both voltage sources as illustrated at an intermediate position. Thus, the magnet may be energized at low voltage to provide a low level of magnetic influence over the sub-adjacent bowling pin whereby to cause the magnet to "seek" the head of the pin. Thereafter, when the magnet is energized at the higher voltage level, the magnet will of course serve to magnetically grip and hold the bowling pin. The foregoing may obviously be accomplished absent significant vertical movement of the magnet. The simple switching operation may of course be accomplished by a conventional controller associated with the automatic pinsetter.

Figure 21:
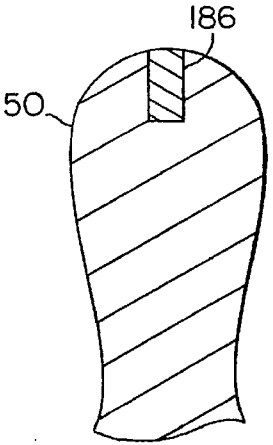
FIG. 21 is an enlarged fragmentary view of a head portion of a bowling pin showing a permanent magnet embedded therein.

The manner in which a conventional bowling pin is rendered magnetically responsive may vary widely in accordance with the present invention. As best illustrated in FIG. 21 a small but powerful permanent magnet 186 may be embedded in an upper end portion or head of a magnet 50 and the magnet may be of the recently developed anodyne type. A variety of other types of small powerful magnets, may also be employed.

Figure 22:
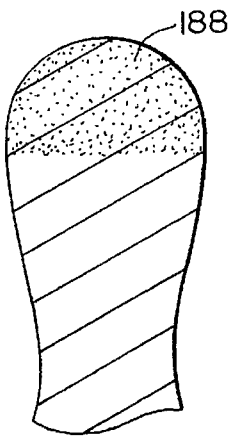
FIG. 22 is a view similar to FIG. 21 but showing an alternative fore of magnetic means in the head of a bowling pin.

As illustrated in FIG. 22 it is also possible to provide magnetically responsive bowling pins by providing a multiplicity of small particles 188,188 of magnetic material dispersed throughout an upper end portion of a bowling pin. The magnetic particles may for example be dispersed in a resin of which the bowling pin is formed.

Figure 23:
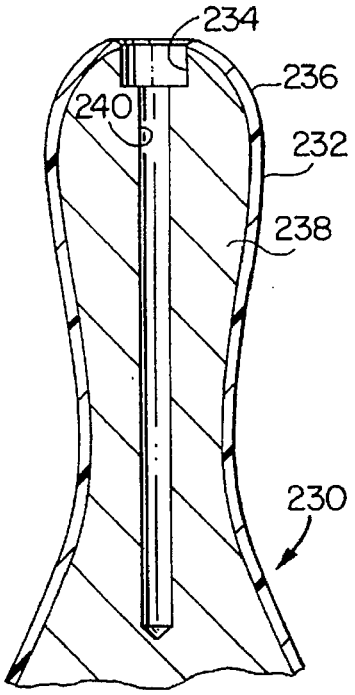
FIG. 23 is an enlarged fragmentary sectional view of a head portion of a bowling pin showing first and second cavities therein respectively for receiving a permanent magnet and for compensation for the weight of the magnet.

The presently preferred magnetically responsive bowling pins are illustrated in FIGS. 23 through 27. In FIG. 23, a bowling pin indicated generally at 230 in an upright attitude has a head portion 232 provided with a first cavity 234 which may conveniently take the form of a bore opening upwardly or longitudinally outwardly through the encapsulating plastic 236 about a wood core 238 of the bowling pin. The bore 234 also has a communicating co-axial bore 240 which is significantly smaller in diameter and thus of reduced cross-sectional configuration and the latter bore extends longitudinally downwardly a considerable distance within the head portion of the bowling pin. As shown, the bore 240 is approximately five (5) inches in length in a conventional bowling pin. The length of the bore 240 is determined by the mount of material, wood in the present instance, to be removed in order to compensate for the weight of a permanent magnet and the slight additional weight of other plastic elements to be disposed in the bore 234. Thus, the gross weight, weight distribution and the balance of the bowling pin is not disturbed by the assembly of the magnet, and plastic elements in the cavity 234. This is an important consideration in view of the severe requirements imposed on bowling pin specifications by the American Bowling Congress and other similar organizations.

Figure 24:
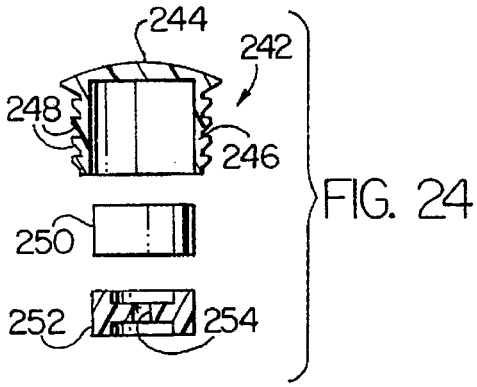
FIG. 24 is an exploded view showing a plastic cap, a permanent magnet which resides within the skirt of the cap in assembled relationship and a plastic plug which resides within the skirt of the cap beneath the magnet in assembled relationship.
Figure 25:
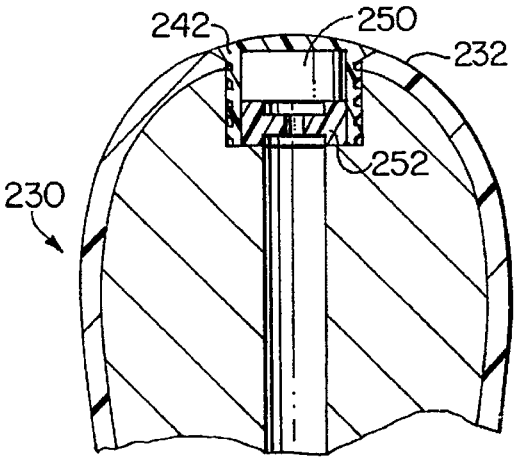
FIG. 25 is a fragmentary sectional view of an enlarged head portion of the bowling pin showing the cap, magnet and plug in assembled relationship in the head portion of a bowling pin.

In FIG. 24 a plastic cap 242 includes a top or closure portion 244 and a skirt 246. The top portion 244 is shown with a slightly arcuate outer surface so as to conform to the arcuate contour of the bowling pin 230 at its head portion 232. The skirt 246 includes integral annular ribs 248 which preferably have sharp edges inclined upwardly to provide for secure retention of the cap in the cavity 284. Magnet 250 may take an annular configuration so as to fit within the skirt 246 as illustrated in FIG. 25. Plastic plug 252 is assembled beneath the magnet 250 as illustrated in FIG. 25 to prevent the magnet from moving vertically within the skirt 246 of the cap 242. Central opening 254 in the plastic plug provides for a degree of contraction of the plug in the radial direction when it is in press fit engagement within the skirt 246. Further, the opening 254 provides for tool access and resulting ease and convenience in the removal of the plug from the skirt 246.

As will be apparent, the cap 242 may be disposed in assembled relationship and in press fit engagement with the wall of the bore or cavity 234 as illustrated in FIG. 25. Similarly, the magnet 250 and the plug 252 may be disposed in press fit engagement within the skirt 246 of the plastic cap. In this manner, secure retention of all elements in the assembled relationship of FIG. 25 is achieved.

Figure 26:
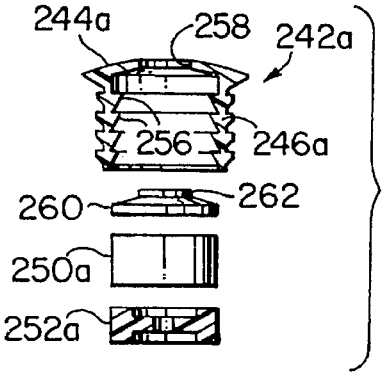
FIG. 26 is an exploded view of an alternative embodiment showing a plastic cap, a steel cap, a magnet, and a plastic plug.
Figure 27:
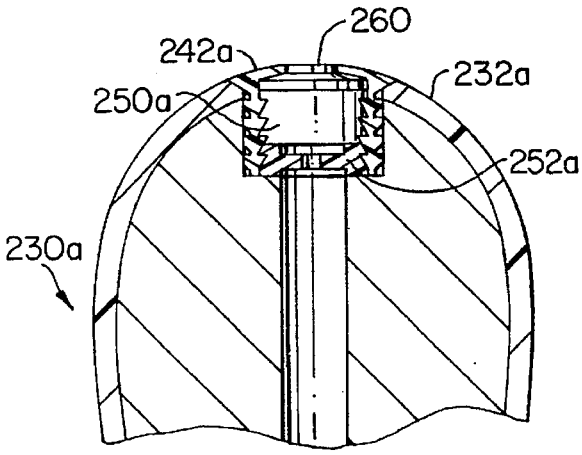
FIG. 27 is a further enlarged fragmentary sectional view of the head portion of a bowling pin showing the FIG. 26 elements in assembled position within the head of the bowling pin.

In FIG. 26, a plastic cap 242*a* is substantially identical with the above described cap 242 except for the provision of an upwardly or longitudinally accessible opening 258 in the top portion 244*a* of the cap and the provision of ribs 256 at the interior surface of the skirt 246*a*. The ribs 256 have sharp upwardly or outwardly inclined edges to retain magnet 250*a* and plastic plug 252*a* within the skirt in press fit engagement therewith. Further, a steel cap 260 is provided for assembly within the cap above the magnet 250*a* and engagement with the top portion 244*a* of the cap 242*a*. A diametrically reduced upper portion 262 of the steel cap enters the opening 258 in the top portion of the cap and is thus exposed upwardly when the elements are in assembled relationship. This relationship is best illustrated in FIG. 27. The remaining elements are assembled in the same manner as in the case of the elements of FIGS. 24 and 25.

With the embodiments of FIGS. 26 and 27, an enhanced magnetic force is achieved due to the inclusion of the exposed steel cap 260.

Various other arrangements and modifications of elements are of course possible within the scope of the invention. For example, the permanent magnet of FIG. 21 may be disposed directly in the bore 234 of FIG. 23 and secured in position by press fitting, adhesive means, etc. The FIG. 22 configuration may also be employed in combination with a weight compensating bore 240.

A sweeper mechanism for removing fallen bowling pins from the bowling alley is or may be conventional and as best illustrated in FIGS. 1 and 3, a sweeper element is provided at 190 and is pivotally mounted on a conveyor chain 192, partially shown in FIG. 1. The sweeper element is moved in one and an opposite direction by reversing movement of the conveyor chain whereby to sweep fallen bowling pins from the bowling alley rearwardly onto the table 33 and to return to its start position. At the start position a small cam member 194 causes the sweeper element 190 to swing upwardly so as not to interfere with bowling balls in progress down the bowling alley.

Figure 28:
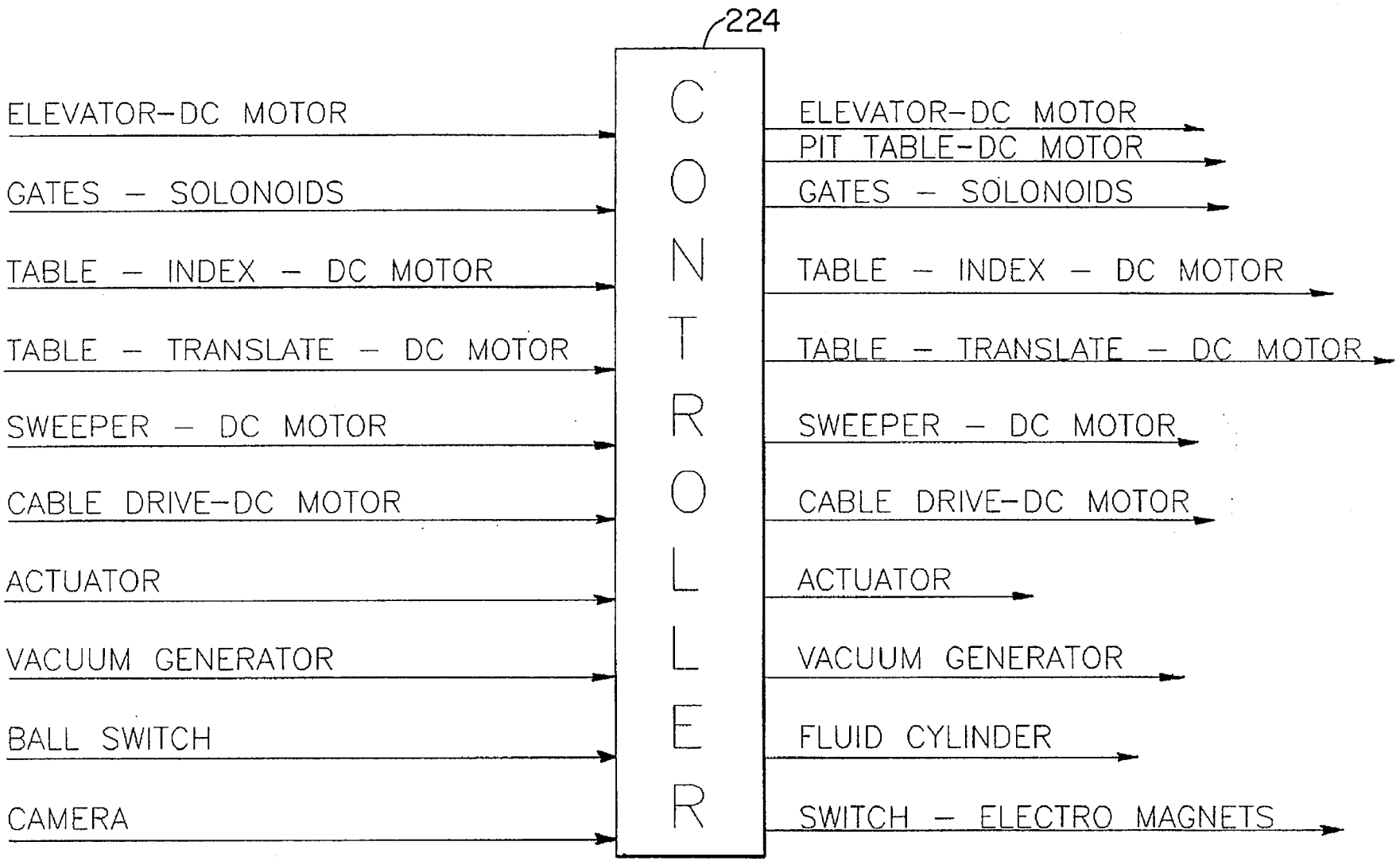
FIG. 28 is a schematic view in block diagram form of a controller for the automatic pinsetter.

Control means for the pinsetter may vary widely within the scope of the invention and may take the form of a conventional microprocessor appropriately programmed to time and interrelate the various machine functions described above. A camera 222 is illustrated schematically in FIG. 1, arranged to view the rear portion of the bowling alley 16 together with pins thereon, and may form a part of a control means in co-operation with a controller 224 in FIG. 28. As mentioned, drive means for the various pinsetter elements may take the form of DC motors and accordingly, the controller has both input and output signals for the various DC motors. Position, speed, acceleration, and other feedback signals may of course be provided to the controller from the various motors as well as the control signals from the controller to the motors. For example, it may be desirable to supply the controller with a signal representative of the indexed position of the table 34 in determining the appropriate control signal to be sent to solenoids of the gates 38,38. Similarly, control signals to the cable drive DC motor in raising and lowering the pinsetting mechanism must of course be coordinated with the control signals to a DC motor operating the sweeper mechanism. A ball switch signal to the controller is of course necessary in the timing of the control signals to the vacuum generator for the suction cup and the fluid cylinder for the rod carrying the cup. Other similar timed and interrelated functions may be attended to by the controller in a conventional manner.

The camera 222 has not been mentioned above and serves to enhance the operating efficiency of the automatic pinsetter. For example, if a bowler throws a "gutter ball" on his first attempt, there is no need for the pinsetting mechanism 20 to descend and raise the remaining upright pins for a sweeping operation. Accordingly, on receipt of such a signal the controller advises the pinsetting mechanism to remain in its elevated position and significant savings in time in the cycle of operation of the setter is achieved, Similarly, after a second ball has been thrown, the camera may inform the controller whether or not upright or fallen pins remain on the bowling alley and the sweeping mechanism is operated accordingly. Still further, when a "strike" is thrown by the bowler, the controller is so advised and operates the pinsetter to immediately provide a new bowling array on the alley through operation of the transfer mechanism, pinsetting mechanism etc. Other refinements in operation are also possible with the camera 222 and the controller 224.

I claim:

1. A bowling pin adapted for use in a magnetically operable automatic pinsetter;

said bowling pin, in an upright attitude, comprising a head portion, a base portion and having an upwardly open cavity in its head portion;

a small permanent magnet disposed in the cavity, a plastic cap with an opening secured in said cavity and at least partially covering said magnet, and, a ferromagnetic element captured between said magnet and cap and exposed through said cap opening.

2. A bowling pin as claimed in claim 1 wherein a plastic plug is disposed in said cavity beneath said permanent magnet.

3. A bowling pin as claimed in claim 1 whereto said plastic cap is provided with external ribs for engaging and gripping the wall of said cavity.

4. A bowling pin as claimed in claim 1 wherein said ribs have sharp edges angularly inclined upwardly to resist withdrawal of said cap from said cavity.

5. A bowling pin as claimed in claim 1 wherein the body portion of said bowling pin is of wood construction.

6. A bowling pin as claimed in claim 1 wherein the surface of said bowling pin is of a plastic material.

7. A bowling pin as claimed in claim 1 wherein the bowling pin is of plastic encapsulated wood construction.

8. A bowling pin adapted for use in an automatic pinsetter wherein magnetic force is employed;

said bowling pin when in an upright attitude having head and base portions and also having a cavity in its head portion;

a small permanent magnet disposed in the cavity, a plastic cap secured in said cavity and at least partially covering said magnet, and a plastic plug disposed in said cavity beneath said permanent magnet.

9. A bowling pin as claimed in claim 8 wherein said plastic cap is provided with external ribs for engaging and gripping a wall of said cavity.

10. A bowling pin as claimed in claim 8 wherein said ribs have edges angularly inclined to resist withdrawal of said cap from said cavity.

11. A bowling pin as claimed in claim 8 having body and surface portions wherein the body portion is of wood construction.

12. A bowling pin as claimed in claim 8 having body and surface portions wherein the surface portion is of a plastic material.

13. A bowling pin adapted for use in an automatic pinsetter wherein magnetic force is employed;

said bowling pin when in an upright attitude having head and base portions and also having a cavity in its head portion;

a small permanent magnet disposed in the cavity, a plastic cap secured in said cavity and at least partially covering said magnet, and said bowling pin also being provided with a second elongated cavity smaller in cross section than said first cavity and extending from a base of said first cavity, said second cavity having a volume which compensates for the weight of the magnet and cap to preserve a desired weight distribution and balance of the bowling pin.

14. A bowling pin as claimed in claim 13 wherein said plastic cap is provided with external ribs for engaging and gripping a wall of said cavity.

15. A bowling pin as claimed in claim 13 wherein said ribs have edges angularly inclined to resist withdrawal of said cap from said cavity.

16. A bowling pin as claimed in claim 13 wherein a body portion of said bowling pin is of wood construction.

17. A bowling pin as claimed in claim 13 wherein a surface portion of said bowling pin is of a plastic material.

18. A bowling pin adapted for use in a magnetically operable automatic pinsetter;

said bowling pin when in an upright attitude comprising head and base portions with an open cavity in its head portion;

a small permanent magnet disposed in the cavity, a plastic cap secured in said cavity and at least partially covering said magnet, said cap including a top portion and a depending skirt, and said magnet being in press fit engagement within said skirt and the skirt in turn being in press fit engagement with a wall of the cavity.

19. A bowling pin as claimed in claim 18 wherein said plastic cap is provided with external ribs for engaging and gripping a wall of said cavity.

20. A bowling pin as claimed in claim 18 wherein said ribs have edges angularly inclined to resist withdrawal of said cap from said cavity.

21. A bowling pin as claimed in claim 18 wherein a body portion of said bowling pin is of wood construction.

22. A bowling pin as claimed in claim 18 wherein a surface portion of said bowling pin is of a plastic material.

23. A bowling pin as claimed in claim 18 wherein a plug is provided beneath said magnet and in press fit engagement within the skirt.

24. A bowling pin as claimed in claim 18 wherein ribs are provided externally said skirt for secure retention of the cap in the cavity.

25. A bowling pin as claimed in claim 18 wherein ribs are provided internally on said skirt for secure retention of the magnet therewithin.

* * * * *